US011584129B2

(12) United States Patent
Fukunaga et al.

(10) Patent No.: US 11,584,129 B2
(45) Date of Patent: Feb. 21, 2023

(54) INKJET RECORDING APPARATUS

(71) Applicant: KYOCERA Document Solutions Inc., Osaka (JP)

(72) Inventors: Yasuyuki Fukunaga, Osaka (JP); Yuzo Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 38 days.

(21) Appl. No.: 17/215,273

(22) Filed: Mar. 29, 2021

(65) Prior Publication Data

US 2021/0309011 A1 Oct. 7, 2021

(30) Foreign Application Priority Data

Apr. 3, 2020 (JP) ..... JP2020-067599

(51) Int. Cl.
*B41J 2/165* (2006.01)

(52) U.S. Cl.
CPC ..... *B41J 2/16511* (2013.01)

(58) Field of Classification Search
CPC ..... B41J 2/16511
See application file for complete search history.

(56) References Cited

U.S. PATENT DOCUMENTS

2014/0210903 A1 7/2014 Tanda
2015/0116422 A1* 4/2015 Tanda ..... B41J 2/16547 347/29
2017/0297339 A1* 10/2017 Midorikawa ..... B41J 2/16547

FOREIGN PATENT DOCUMENTS

JP 2014-144585 A 8/2014
WO WO-2017022396 A1 * 2/2017 ..... B41J 2/165

* cited by examiner

*Primary Examiner* — Sharon Polk
(74) *Attorney, Agent, or Firm* — Studebaker & Brackett PC

(57) ABSTRACT

An inkjet recording apparatus includes a recording head, a housing, a cap unit, a protrusion and a guide part. The recording head has an ink ejecting port on a lower face. The housing supports the recording head. The cap unit includes a cap. The cap unit is inserted into a space below the recording head in a predetermined direction to be attached to the housing and to cover the lower face of the recording head with the cap. The protrusion is protruded from a lower portion of the housing on a rear side in the predetermined direction more downward than the lower face of the recording head. The guide part is formed in an upper portion of the cap unit on the rear side in the predetermined direction and comes into contact with the protrusion so as to guide insertion and removal of the cap unit.

13 Claims, 18 Drawing Sheets

I – I

INKJET RECORDING APPARATUS

INCORPORATION BY REFERENCE

This application is based on and claims the benefit of priority from Japanese patent application No. 2020-067599 filed on Apr. 3, 2020, which is incorporated by reference in its entirety.

BACKGROUND

The present disclosure relates to an inkjet recording apparatus including a cap unit for preventing liquid leakage from a recording head.

An inkjet recording apparatus forms an image on the sheet by ejecting an ink drop through a plurality of nozzles provided on a lower face of a recording head. However, when the image formation is not performed, moisture evaporates from the ejecting port of the tip end of the nozzle to dry the ink, and the ejecting port may be clogged. Then, a technique for preventing drying of ink by mounting a cap on the recording head has been conventionally discussed. For example, the cap may be provided with a long plate-shaped cap body, and an annular rib protruding from the upper face of the cap body and having an oval shape in a plan view. At a time of the image formation, the cap unit is retracted to the lateral side of a conveyance belt facing the recording head. When the image formation is completed, the conveyance belt is lowered, the cap unit is moved to a position facing the recording head, the cap unit is lifted by lifting of a conveying belt, and the annular rib is pressed against the lower face of the recording head.

By the way, when the inkjet recording apparatus is shipped from a factory, the ink is not filled in order to prevent deterioration of the ink, and the recording head is filled with a storage liquid in order to prevent generation of bubbles when the ink is filled. Therefore, in the above configuration, when an atmospheric pressure changes during transportation, there is a possibility that the storage liquid leaks from between the annular rib and the recording head.

Then, it is considerable that the cap unit is configured to press an elastic body on the entire area of the lower face of the recording head and to seal the ejecting ports. In this case, a work is required, in which after the conveyance unit is removed to secure a work space before shipping, the cap unit is inserted from the lateral side and then attached to the recording head. However, it is difficult to perform a screw fastening work on the rear side of the apparatus. Then, a configuration is considered that the rear side end portion of the cap unit is inserted into a recess formed in the apparatus main body and the front side of the cap unit is fixed to the apparatus main body by a screw. In this case, first, the cap unit is inserted in such a manner that the rear side is inclined to be higher, and the rear side end portion is inserted, and then the front side is lifted to be fixed to the apparatus main body. There is a possibility that when the cap unit is inserted into the work space, the rear side end portion comes into contact with the recording head and the recording head is damaged. Also, there is a similar possibility when the cap unit is removed after installation of the apparatus.

Further, an inkjet recording apparatus for color printing is provided with a plurality of the recording heads which ejects ink drops of different colors. The recording heads may vibrate at different phases for each recording head during transportation. In this case, depending on the recording head, the phase of the vibration is shifted from that of the cap unit, and the sealing property of the ejecting port may be deteriorated. In order not to deteriorate the sealing property, it is necessary to firmly fix the cap unit, but the attaching and detaching work may become complicated.

SUMMARY

In accordance with an aspect of the present disclosure, an inkjet recording apparatus includes a recording head, a housing, a cap unit, a protrusion and a guide part. The recording head has an ink ejecting port on a lower face. The housing supports the recording head. The cap unit includes a cap. The cap unit is inserted into a space below the recording head in a predetermined direction to be attached to the housing and to cover the lower face of the recording head with the cap. The protrusion is protruded from a lower portion of the housing on a rear side in the predetermined direction more downward than the lower face of the recording head. The guide part is formed in an upper portion of the cap unit on the rear side in the predetermined direction and comes into contact with the protrusion so as to guide insertion and removal of the cap unit.

In accordance with another aspect of the present disclosure, an inkjet recording apparatus includes a plurality of recording heads, a housing and a cap unit. The plurality of recording heads each has an ink ejecting port on a lower face. The housing supports the plurality of recording heads. The cap unit includes a plurality of caps. The cap unit is inserted into a space below the plurality of recording heads in a predetermined direction to be attached to the housing and to cover the lower faces of the plurality of recording heads with the caps. The cap unit includes a lower layer part and a plurality of upper layer parts. The lower layer part is mounted to the housing. The plurality of upper layer parts is provided above the lower layer part and includes the caps. Each of the plurality of upper layer parts faces each of the plurality of the recording heads and is capable of being lifted and lowered independently.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a printer 1 (an inkjet recording apparatus) according to one embodiment of the present disclosure will be described.

Figure 1:
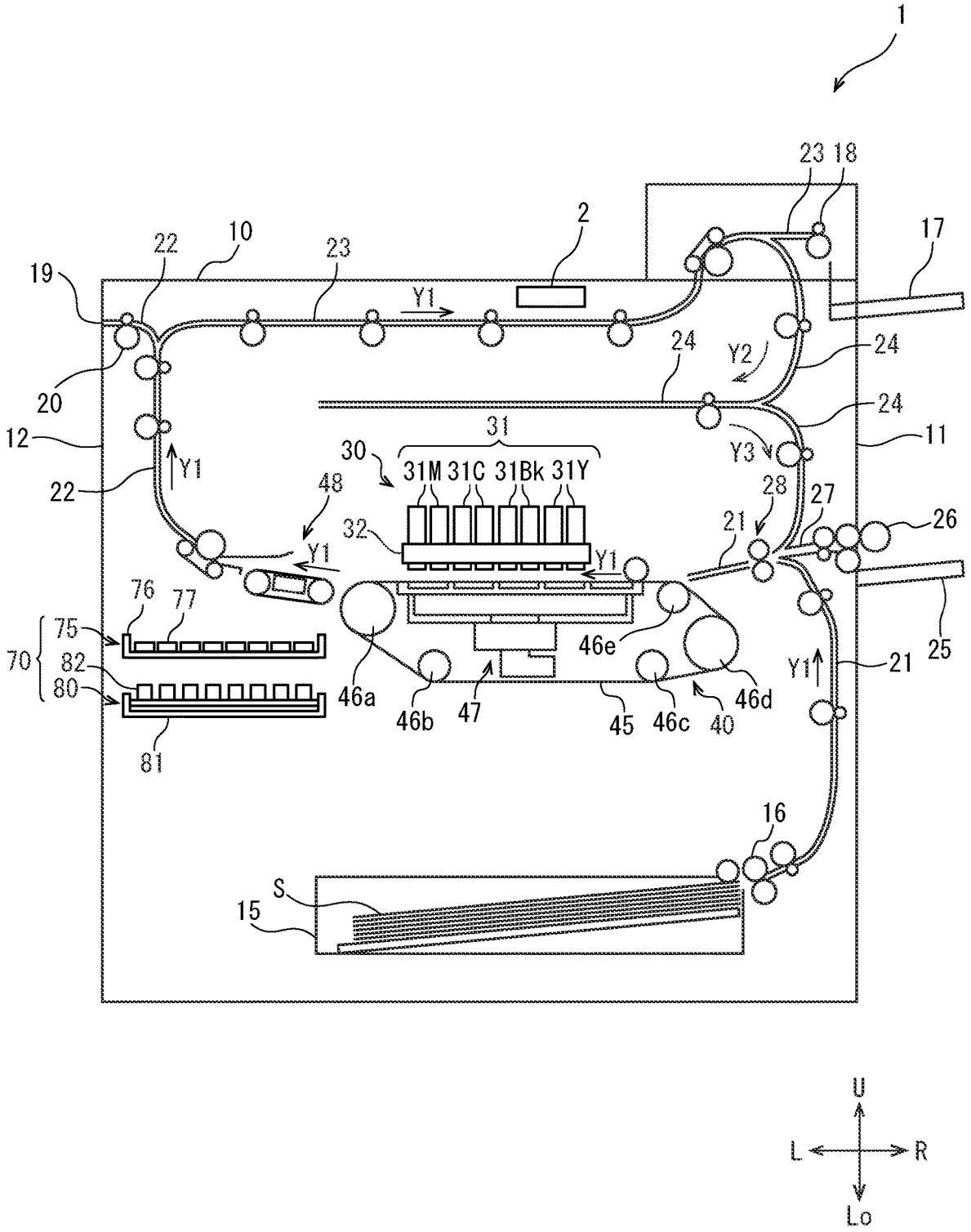
FIG. 1 is a front view schematically showing an inner structure of a printer according to one embodiment of the present disclosure.
Figure 2:
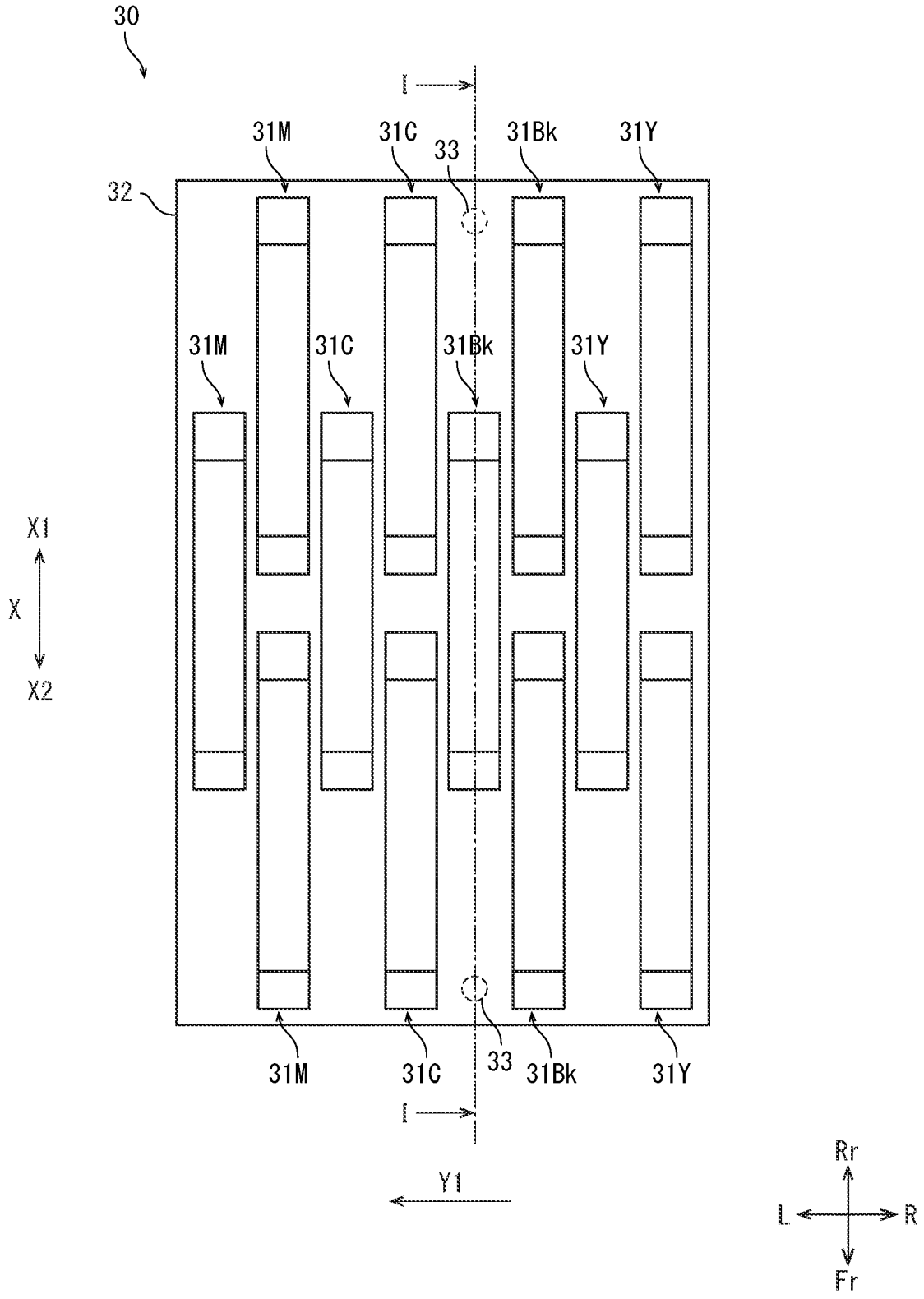
FIG. 2 is a plan view schematically showing a structure of a recording head unit according to the embodiment of the present disclosure.
Figure 3:
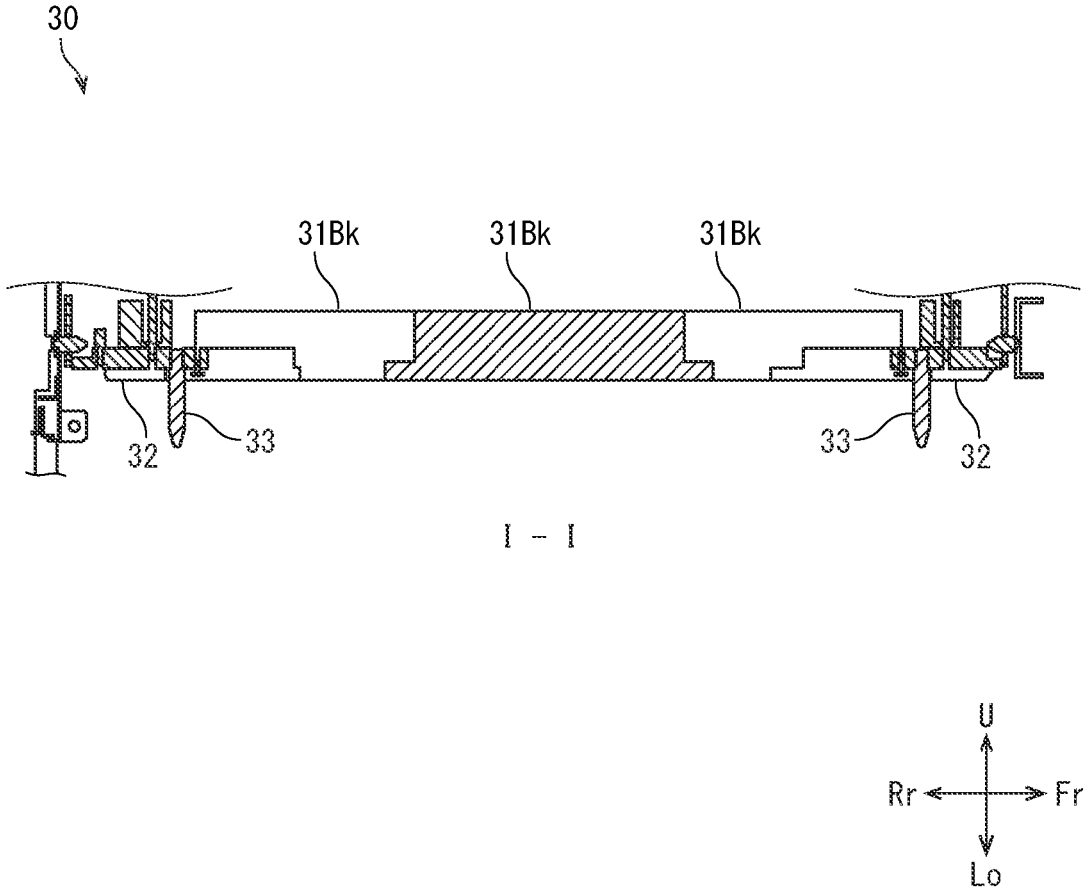
FIG. 3 is a sectional view showing the recording head unit according to the embodiment of the present disclosure.

First, an entire structure of the printer 1 will be described. FIG. 1 is a front view schematically showing an inner structure of the printer 1. FIG. 2 is a plan view schematically showing a structure of a recording head unit 30. FIG. 3 is a sectional view showing the recording head unit 30. In the following description, a front side on a paper plane on which FIG. 1 is drawn is defined as a front side of the printer 1, and a left side and a right side are described based on a direction when the printer 1 is viewed from the front side. "U", "Lo", "L", "R", "Fr" and "Rr" marked in each figure show "upper", "lower", "left", "right", "front" and "rear", respectively.

As shown in FIG. 1, the printer 1 is an inkjet type image forming apparatus which forms an image by ejecting an ink on a sheet S (a plain paper, a coated paper, etc.), and can perform one-side printing and both-side printing on the sheet S. The printer 1 includes a box-shaped main body housing 10 in which various kinds of devices are stored. In the lower portion of the main body housing 10, a sheet feeding cassette 15 in which the sheet S is stored is provided in a drawable manner, and on the right side face 11 of the main body housing 10, a manual sheet feeding tray 15 on which the sheet S is placed manually is provided. Above the manual sheet feeding tray 25, a sheet discharge tray 17 on which the printed sheets S are stacked is provided, and on the upper left side face 12, a sheet discharge port 19 through which the sheet S is conveyed to a post-processing device (not shown) is formed.

In the center portion of the main body housing 10, a recording head unit 30 which forms an image on the sheet S is provided. Below the recording head unit 30, a print and conveyance unit 40 (an example of a conveyance unit) which conveys the sheet S on which the image is to be formed is provided. On the left side of the print and conveyance unit 40, a drying unit 48 which dries the printed sheet S while conveying it is provided.

On the right side of the print and conveyance unit 40, a first conveying path 21 extending from the sheet feeding cassette 15 to the print and conveyance unit 40, and a manual conveyance path 27 extending from the manual sheet feeding tray 25 and joining to the first conveyance path 21 are provided. On the left side of the drying unit 48, a second conveyance path 22 is formed so as to extend from the drying unit 48 to the sheet discharge port 19. Above the recording head unit 30, a third conveyance path 23 branching from the second conveyance path 22 and joining to the sheet discharge tray 17 and a fourth conveyance path 24 branching from the third conveyance path 23 and joining to the first conveyance path 21 are provided. At a branch point between the second conveyance path 22 and the third conveyance path 23 and a branch point between the third conveyance path 23 and the fourth conveyance path 24, guide members (not shown) which guide the conveyance direction of the sheet S in response to an instruction from a control part 2 are provided.

On the first conveyance path 21, a sheet feeding roller 16 and a resist rollers pair 28 are provided in order from the upstream side in the conveyance direction (the Y1 Direction). The sheet feeding roller 16 feeds the sheets S stored in the sheet feeding cassette 15 to the first conveying path 21 one by one. The resist rollers pair 28 corrects the skew of the sheet S and feeds the sheet S in synchronization with a timing of the image formation.

The manual conveyance path 27 is joined to the first conveyance path 21 at a portion between the sheet feeding roller 16 and the resist rollers pair 28. On the manual conveyance path 27, a manual sheet feeding roller 26 which feeds the sheets S stacked on the manual sheet feeding tray 25 to the manual conveyance path 27 one by one is provided.

[Recording head unit] The recording head unit 30 (refer to FIG. 2 and FIG. 3) is provided with line type recording heads 31Y, 31Bk, 31C and 31M (generally referred to as a recording head 31) in which a plurality of ejecting ports (not shown) disposed in a width direction crossing the conveyance direction are formed on the lower face. In order from the upstream side in the conveyance direction, the recording heads 31Y, 31Bk, 31C and 31M are disposed, and they eject yellow, black, cyan and magenta inks respectively. The three recording heads 31Y, 31Bk, 31C and 31M are disposed in a zigzag manner for each ink color. The number of the recording heads 31Y, 31Bk, 31C and 31M may be one, two or four or more. The lower face of the recording head 31 is made of metal.

[Print and conveyance unit] The print and conveyance unit 40 (refer to FIG. 1) includes a drive roller 46*a*, a plurality of driven rollers 46*b*, 46*c*, 46*d* and 46*e*, a conveyance belt 45 wound around them, and a suction part 47. The drive roller 46*a* is driven by a drive source (not shown) such as a motor to drive the conveyance belt 45. The conveyance belt 45 has a large number of through holes. The suction part 47 is disposed inside the conveyance belt 45 so as to face the recording head unit 30, and generates negative pressure in the through holes of the conveyance belt 45 by sucking air.

The drying unit 48 includes a belt which sucks and conveys the sheet S in the same manner as the print and conveyance unit 40, and dries the sheet S by air. At the downstream end portion of the second conveyance path 22 in the conveyance direction, a first sheet discharge roller 20 which discharges the sheet S through the sheet discharge port 19 is provided. At the downstream end portion of the third conveyance path 23 in the conveyance direction, a second sheet discharge roller 18 which discharges the sheet S to the sheet discharge tray 17 is provided. The fourth conveyance path 24 feeds the sheet S reversed upside down to the first conveyance path 21 by switching back it in a case of both-side printing.

Next, an image forming operation of the printer 1 will be described. When an image formation instruction is input to the printer 1, the sheet S is fed from the sheet feeding cassette 15 or the manual sheet feeding tray 25 and conveyed along the first conveyance path 21 in the Y1 direction. Then, the leading end portion (the downstream side end portion in the conveyance direction) of the sheet S is abutted against a nip region of the resist rollers pair 28 whose rotation is stopped, thereby correcting the skew of the sheet S, and the sheet S is conveyed from the resist rollers pair 28 to the print and conveyance unit 40 in synchronization with the ejection timing of the ink drop by the recording head unit 30. The sheet S is sucked to the conveyance belt 45 and conveyed in the Y1 direction. The inks are ejected from the recording heads 31Y, 31Bk, 31C and 31M toward the sheet S to form an image on the first side face of the sheet S.

The sheet S on which an image is formed on the first side face is sucked by the belt of the drying unit 48 and conveyed along the second conveyance path 22 and the third conveyance path 23. At a time of one-side printing, the sheet S id discharged by the second sheet discharge roller 18 to the sheet discharge tray 17. On the other hand, at a timer of both-side printing, the sheet S is guided to the fourth conveyance path 24 and switched back, and is conveyed to the resist rollers pair 28 in an upside down state, and an image is formed on the second side face. The sheet S on which an image is formed on the second side face is discharged through the second conveyance path 22 and the third conveyance path 23 to the sheet discharge tray 17.

Figure 6:
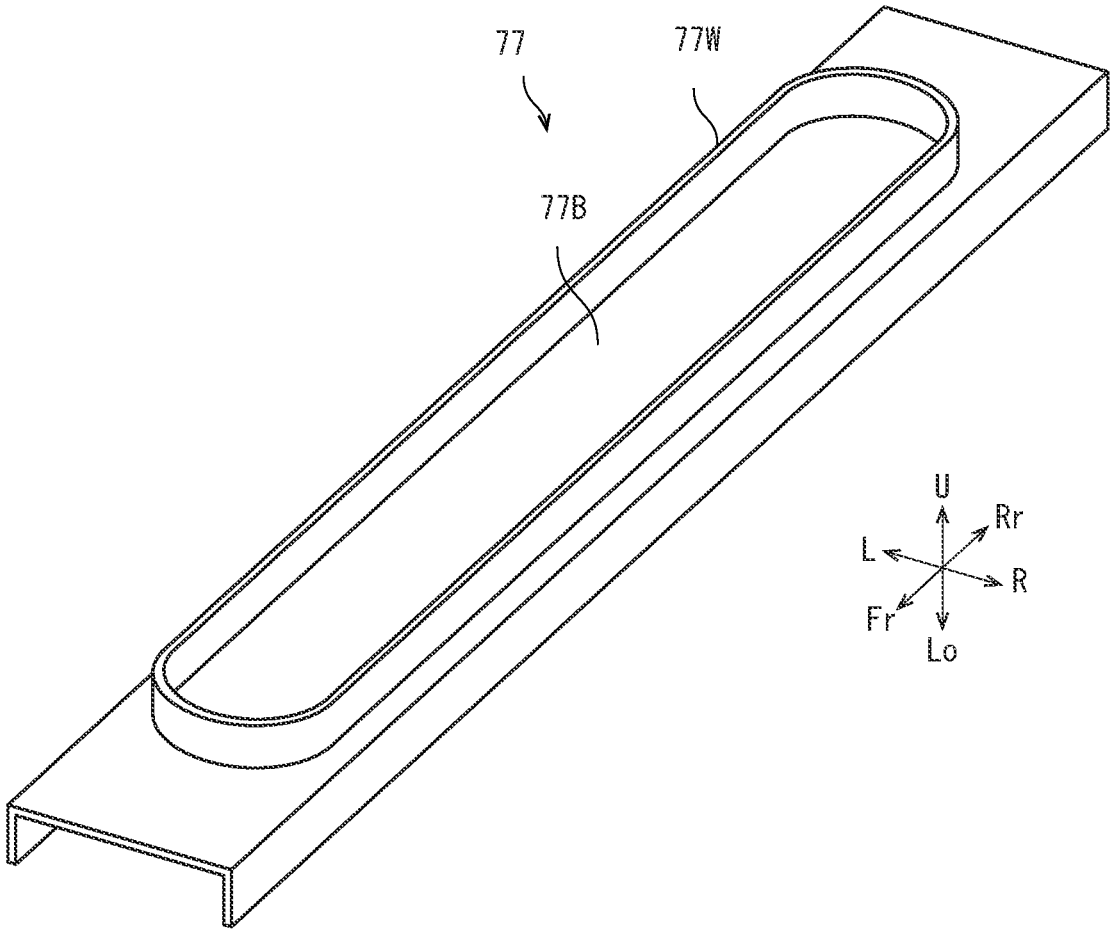
FIG. 6 is a perspective view showing a cap according to the embodiment of the present disclosure.

Next, the recording head unit 30, the print and conveyance unit 40 and a treatment unit 70 will be described. FIG. 4A to FIG. 5B are perspective views showing the print and conveyance unit 40 and the treatment unit 70. FIG. 6 is a perspective view showing a cap 77.

[Recording head housing] The recording head 31 is supported by a recording head housing 32 (refer to FIG. 2 and FIG. 3). The recording head housing 32 may be fixed to the main body housing 10 by a screw or the like, or may be formed integrally with the main body housing 10 (an example of a housing). In the front end portion and the rear end portion of the recording head housing 32, positioning pins 33 (an example of a protrusion) are protruded downward more lower than the lower face of the recording head 31. The print and conveyance unit 40 includes positioning pin holes 44 (an example of a recess) into which the positioning pins 33 are inserted, on the front side and the rear side of the conveyance belt 45 (refer to FIG. 4A).

Figure 4A:
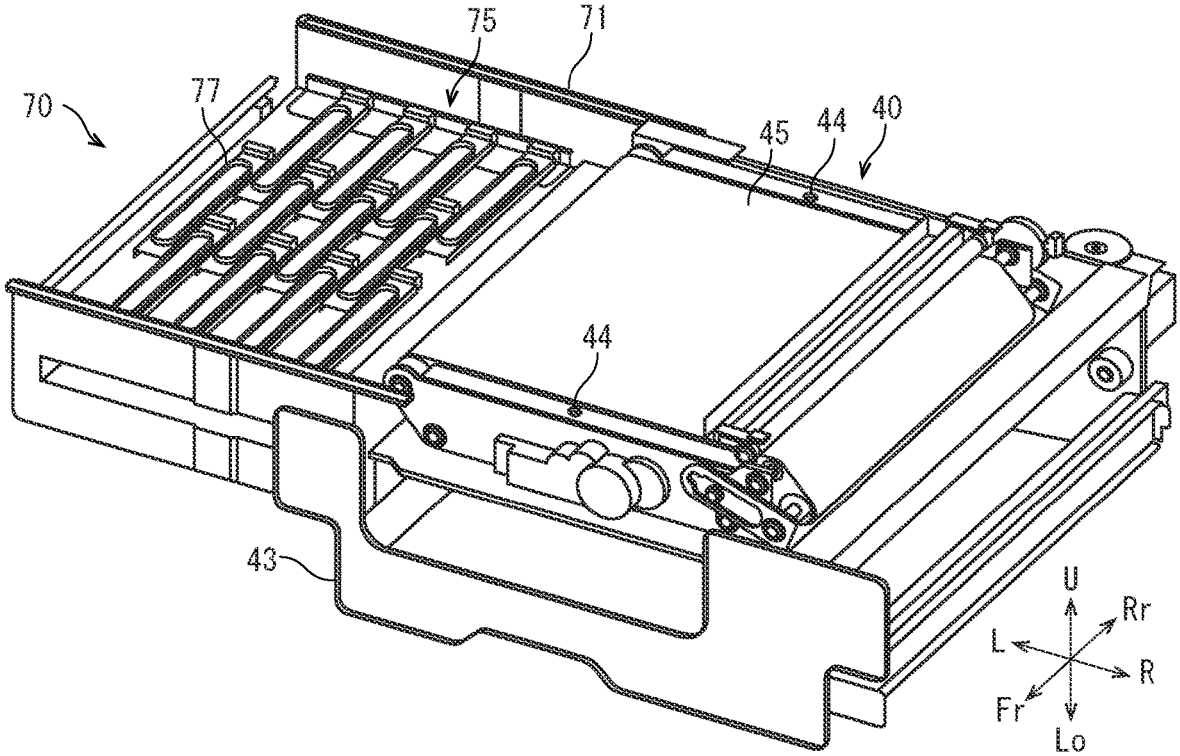
FIG. 4A is a perspective view showing a print and conveyance unit and a treatment unit according to the embodiment of the present disclosure.
Figure 4B:
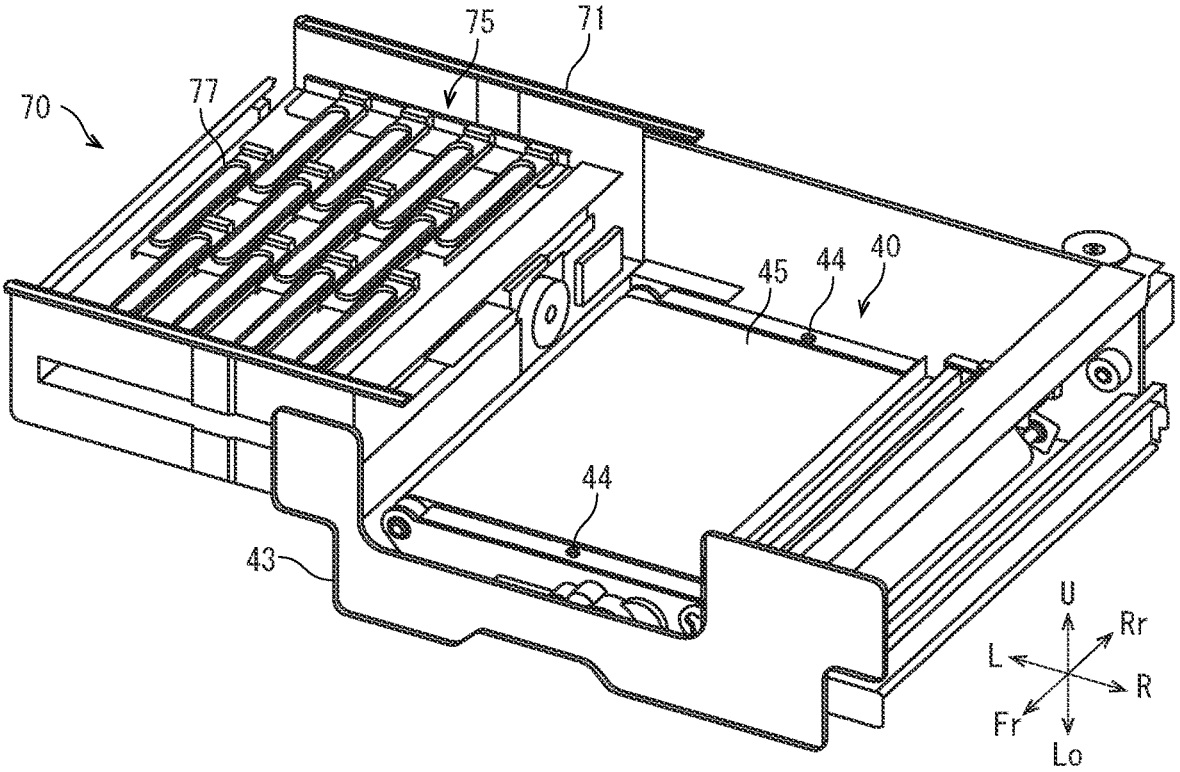
FIG. 4B is a perspective view showing the print and conveyance unit and the treatment unit according to the embodiment of the present disclosure.
Figure 5A:
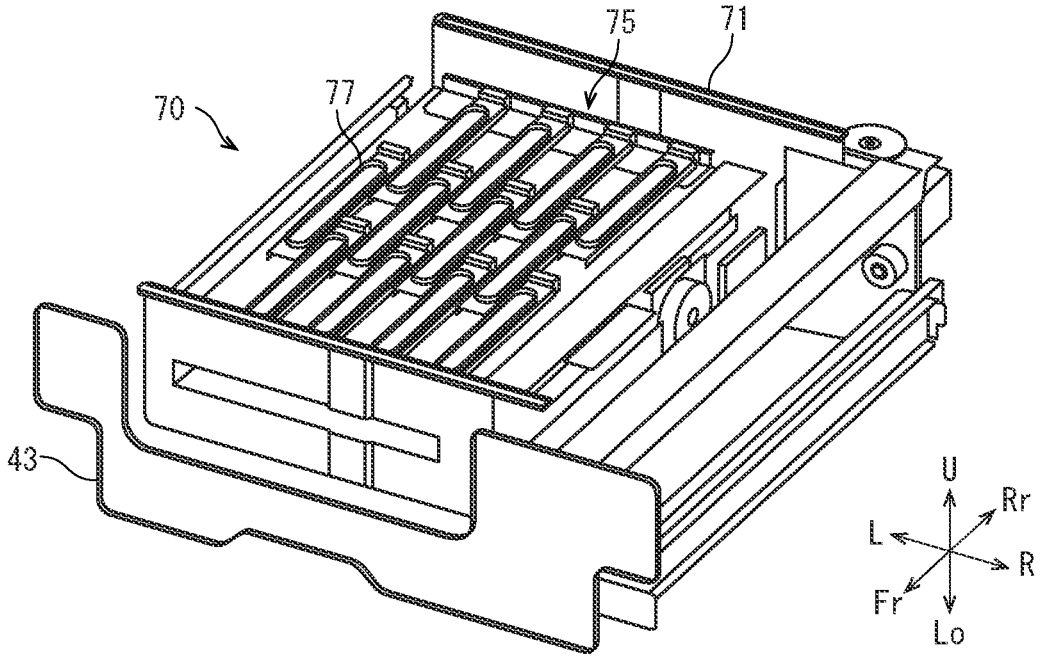
FIG. 5A is a perspective view showing the print and conveyance unit and the treatment unit according to the embodiment of the present disclosure.
Figure 5B:
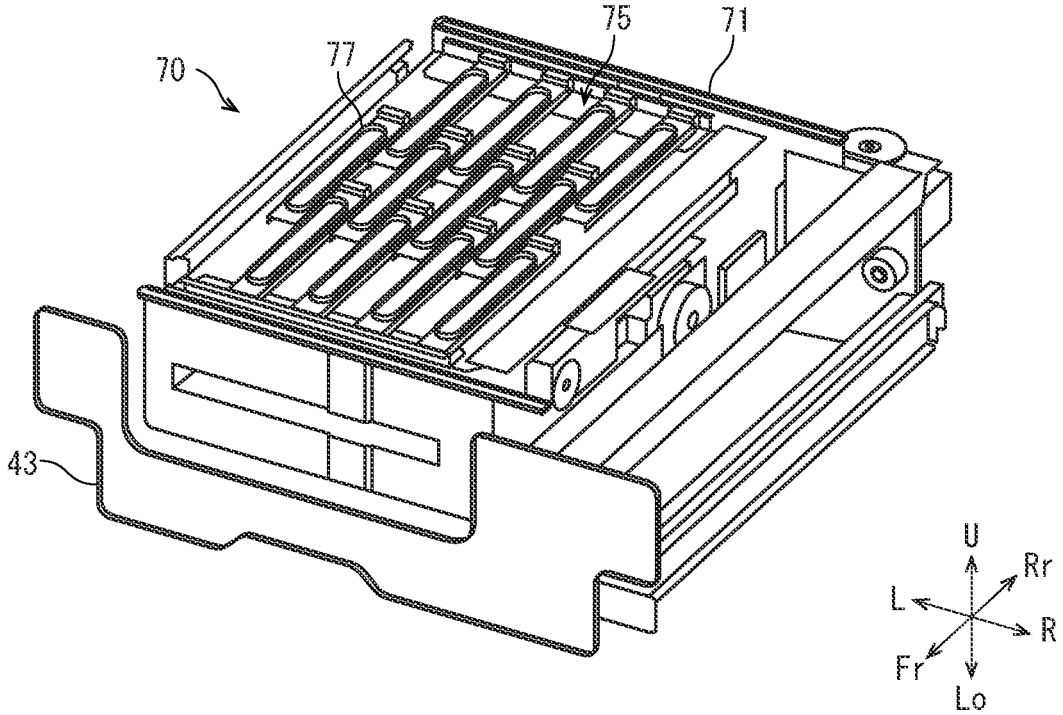
FIG. 5B is a perspective view showing the print and conveyance unit and the treatment unit according to the embodiment of the present disclosure.

[Frame] The print and conveyance unit 40 is supported by a frame 43 fixed to the main body housing 10 (refer to FIG. 4A and FIG. 4B). The frame 43 is configured so as to surround the print and conveyance unit 40 and whose upper face and left face are opened. The print and conveyance unit 40 is supported by the frame 43 via a lifting and lowering mechanism (not shown) The lifting and lowering mechanism lifts and lowers the print and conveyance unit 40 with respect to the frame 43, for example, by using a pulley which drives a wire coupled to the print and conveyance unit 40, a rack-and-pinion, a ball screw, a linear motor, a cam mechanism and the others.

[Treatment unit] The treatment unit 70 (refer to FIG. 4A and FIG. 4B) includes a first cap unit 75 which prevents clogging of the ejecting ports of the recording heads 31, a wipe unit 80 (refer to FIG. 1) which cleans the lower face of the recording heads 31 and a carriage 71 which supports the first cap unit 75 and the wipe unit 80.

[First cap unit] The first cap unit 75 includes a supporting plate 76 and caps 77 provided on the upper face of the supporting plate 76. One cap 77 is provided for each recording head 31. The cap 77 (refer to FIG. 6) is made of rubber, for example, and has a bottom plate part 77B and an annular wall part 77W provided on the upper face of the bottom plate part 77B. The wall part 77W has a pair of straight portions whose longitudinal direction is along the front-and-rear direction and facing each other in the left-and-right direction, and a pair of arc-shaped portions connecting both ends of the straight portions, and has a size so as to surround all of the ejecting ports of one recording head 31.

[Wipe unit] The wipe unit 80 includes a supporting plate 81 and wipe blades 82 provided above the supporting plate 81. The wipe blades 82 are supported by the supporting plate 81 via a wipe mechanism (not shown). The wipe mechanism drives a wire coupled to the wipe blades 82 using a pulley (not shown), for example, and slides the wipe blades 82 in the front-and-rear direction while coming into contact with the lower face of the recording heads 31 to clean the lower faces of the recording heads 31. The supporting plate 81 has a recess on the upper face and is used as a receiver for the ink.

[Carriage] The first cap unit 75 and the wipe unit 80 are supported by the carriage 71. The wipe unit 80 is disposed below the first cap unit 75. The carriage 71 is configured so as to surround the first cap unit 75 and the wipe unit 80, and the upper face and the right side face of the carriage 71 are opened. The carriage 71 is supported by the frame 43 via a carriage slide mechanism (not shown). The carriage slide mechanism slides the carriage 71 in the left-and-right direction with respect to the frame 43 by using a pulley which drives a wire coupled to the carriage 71, for example.

The first cap unit 75 and the wipe unit 80 are liftable and lowerable with respect to the carriage 71. The wipe unit 80 is supported by the carriage 71 via a wipe unit slide mechanism (not shown). The wipe unit slide mechanism slides the wipe unit 80 in the left-and-right direction by driving a wire coupled to the wipe unit 80 using a pulley, for example.

Here, a movement of the print and conveyance unit 40 and the treatment unit 70 with respect to the frame 43 will be described (refer to FIG. 1, FIG. 4A to FIG. 5B). FIG. 4A shows them in the image forming operation. As shown in FIG. 1, the print and conveyance unit 40 is in the image formation position, and the treatment unit 70 is retreated to the retreat position where is on the left side of the print and conveyance unit 40.

At a time of the image non-formation, the first cap unit 75 is attached to the recording head unit 30 in the following procedures. First, the control part 2 lowers the print and conveyance unit 40 to the retreat position by the lifting and lowering mechanism (refer to FIG. 4B). Next, the control part 2 slides the treatment unit 70 to the right side, that is above the print and conveyance unit 40 by the carriage slide mechanism (refer to FIG. 5A). Next, the control part 2 lifts the print and conveyance unit 40 by the lifting and lowering mechanism so as to push up the first cap unit 75 via the wipe unit 80 (refer to FIG. 5B). Then, the upper end portions of the wall parts 77W of the caps 77 are pressed on the lower face of the recording head 31. Thus, the first cap unit 75 is attached to the recording head unit 30.

When the lower face of the recording head 31 is cleaned, the control part 2 slides the wipe unit 80 only to above the print and conveyance unit 40 from the state shown in FIG. 4B by the wipe unit sliding mechanism, then lifts the print and conveyance unit 40 by the lifting and lowering unit so as to push up the wipe unit 80 (the state is not shown), and then slides the wipe blades 82 in the front-and-rear direction by the wipe mechanism to clean the lower faces of the recording heads 31.

Figure 7:
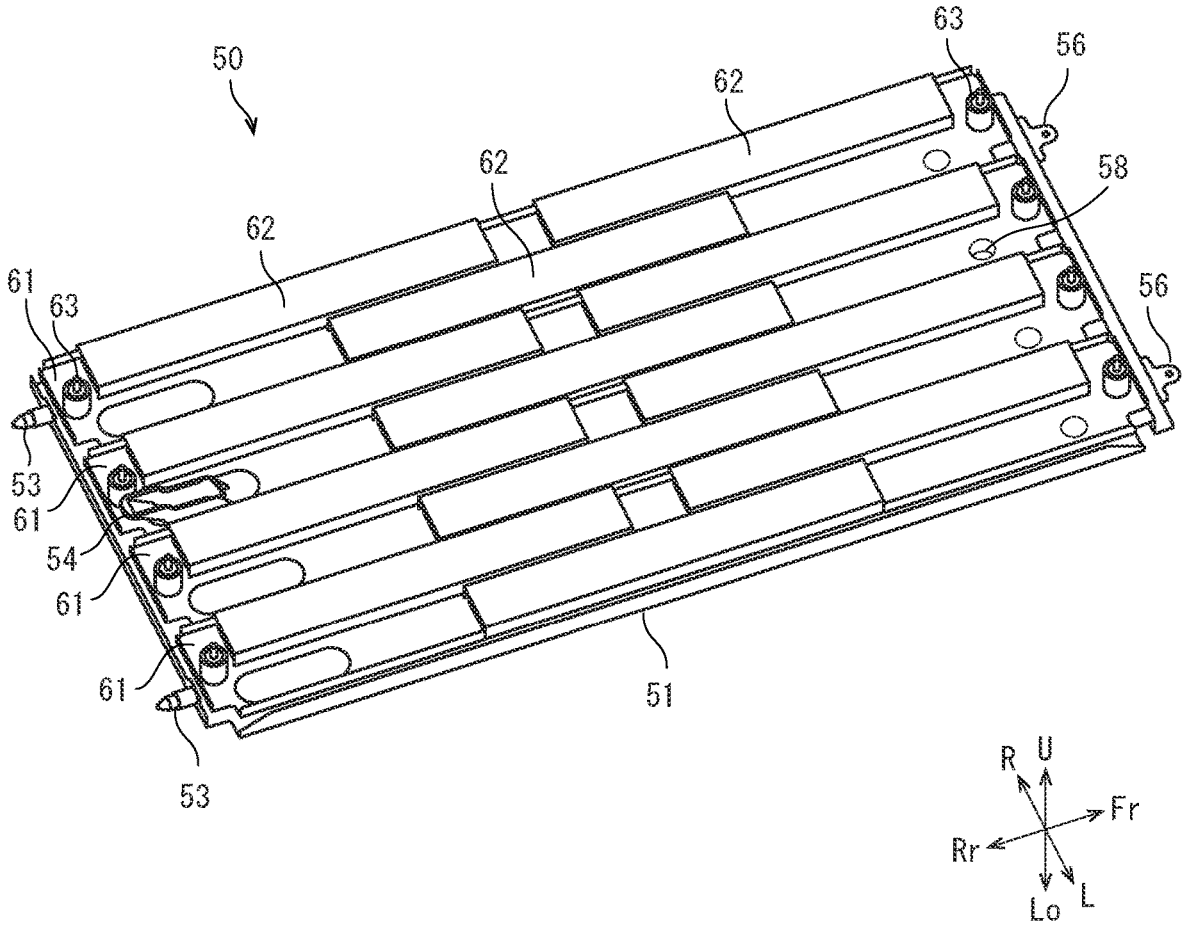
FIG. 7 is a perspective view showing a second cap unit according to the embodiment of the present disclosure.
Figure 8A:
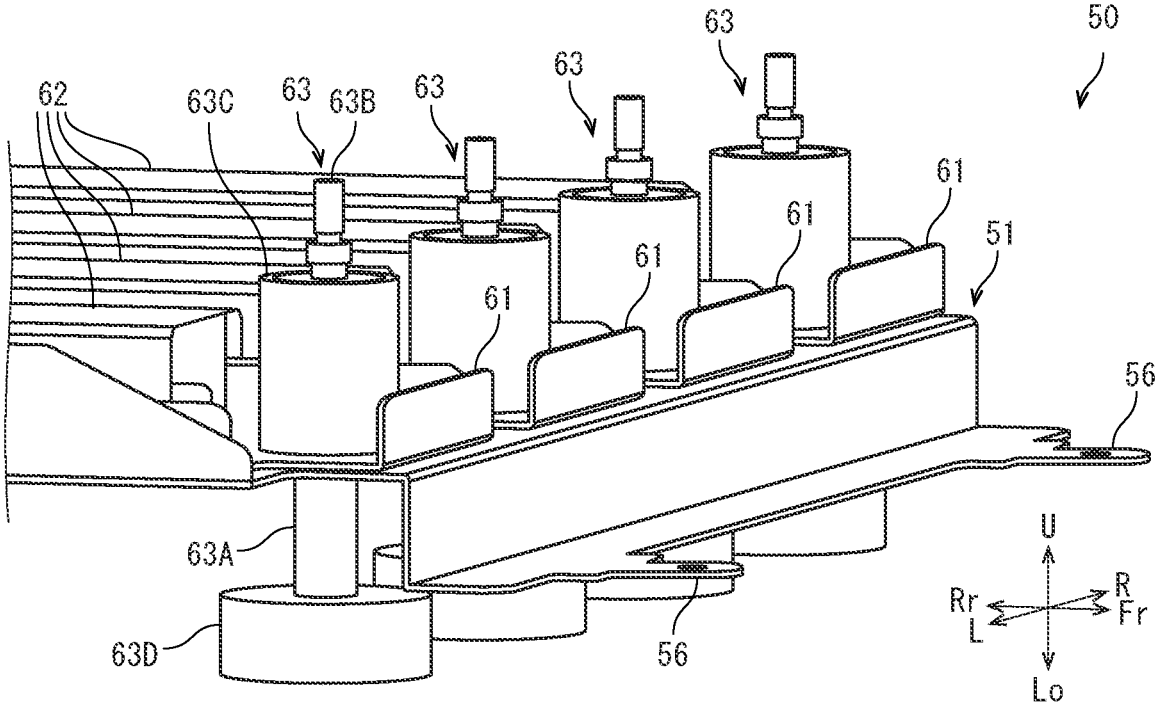
FIG. 8A is a perspective view showing a front end portion of the second cap unit according to the embodiment of the present disclosure.
Figure 8B:
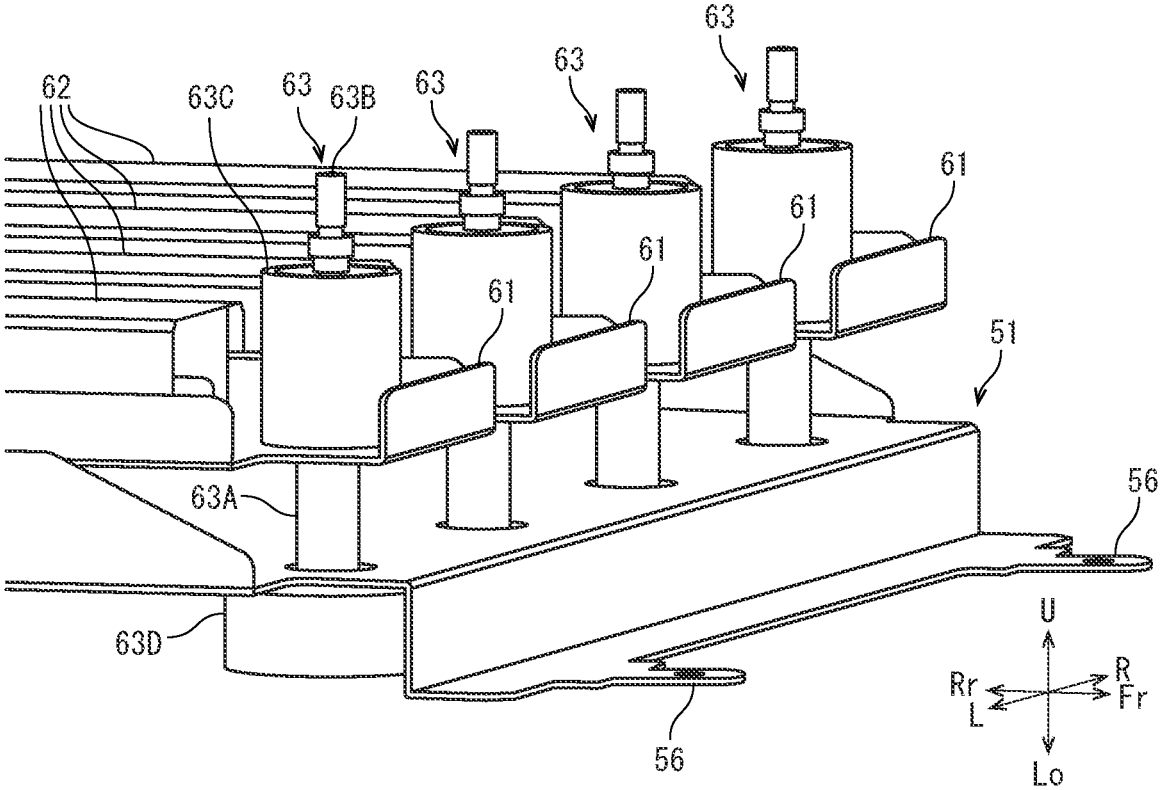
FIG. 8B is a perspective view showing the front end portion of the second cap unit according to the embodiment of the present disclosure.
Figure 9A:
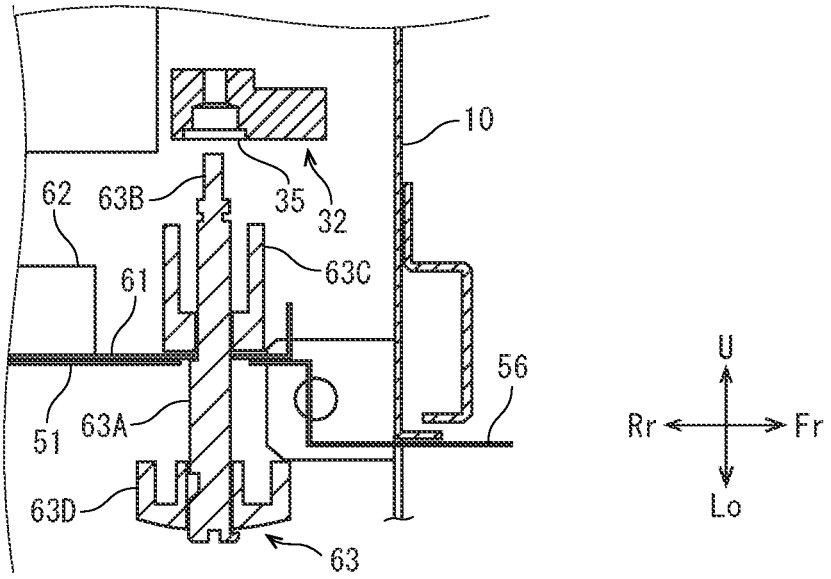
FIG. 9A is a sectional view showing a front side sub-base part mounting screw and a recording head housing according to the embodiment of the present disclosure.
Figure 9B:
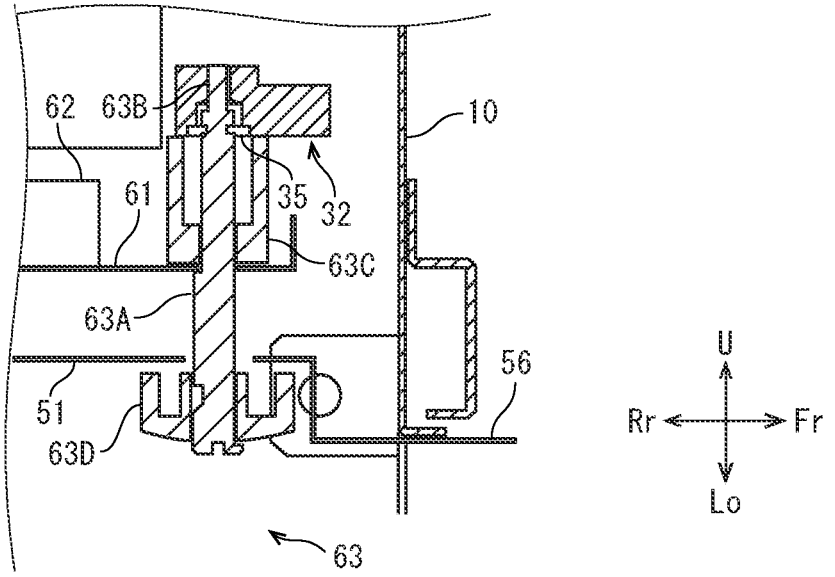
FIG. 9B is a sectional view showing the front side sub-base part mounting screw and the recording head housing according to the embodiment of the present disclosure.
Figure 10:
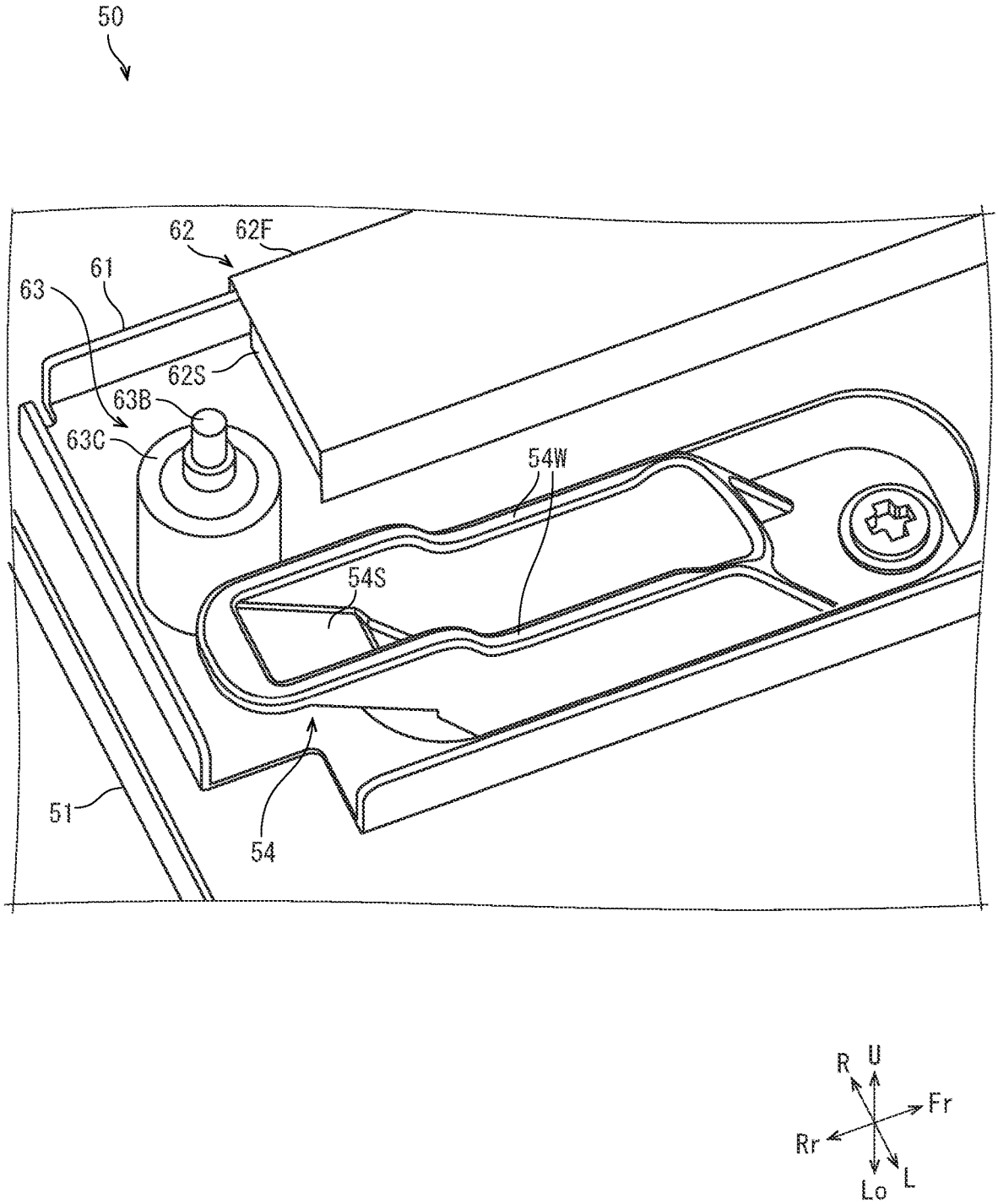
FIG. 10 is a perspective view showing a resin guide and its periphery according to the embodiment of the present disclosure.
Figure 11A:
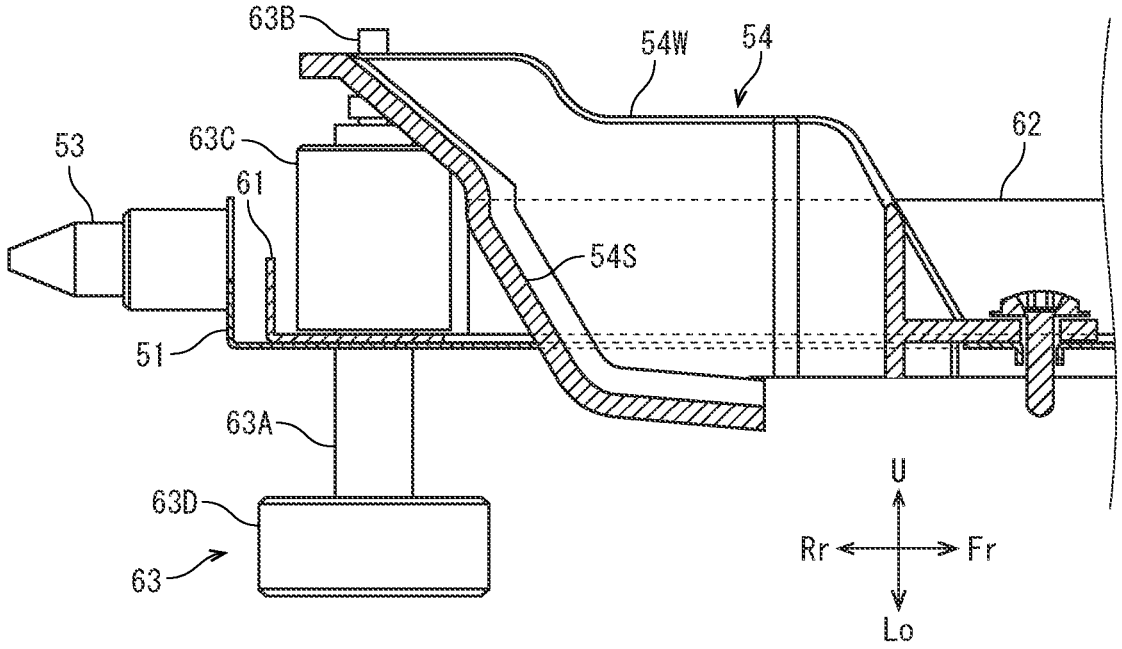
FIG. 11A is a sectional view showing the resin guide and its periphery according to the embodiment of the present disclosure.
Figure 11B:
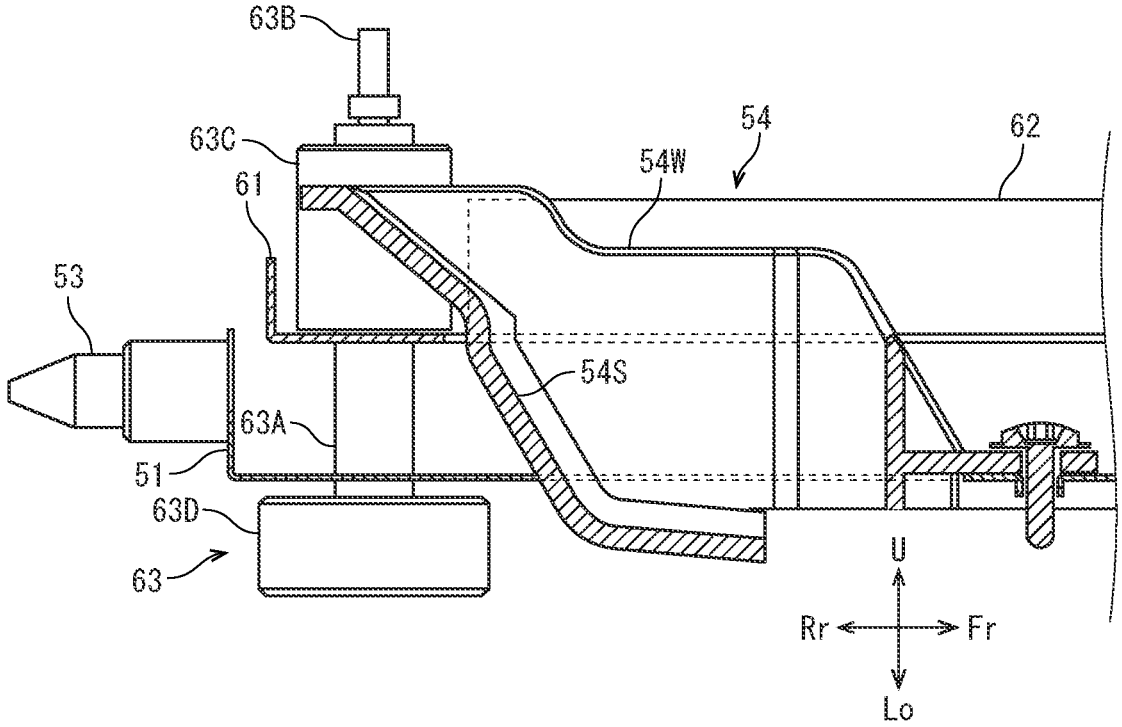
FIG. 11B is a sectional view showing the resin guide and its periphery according to the embodiment of the present disclosure.
Figure 12A:
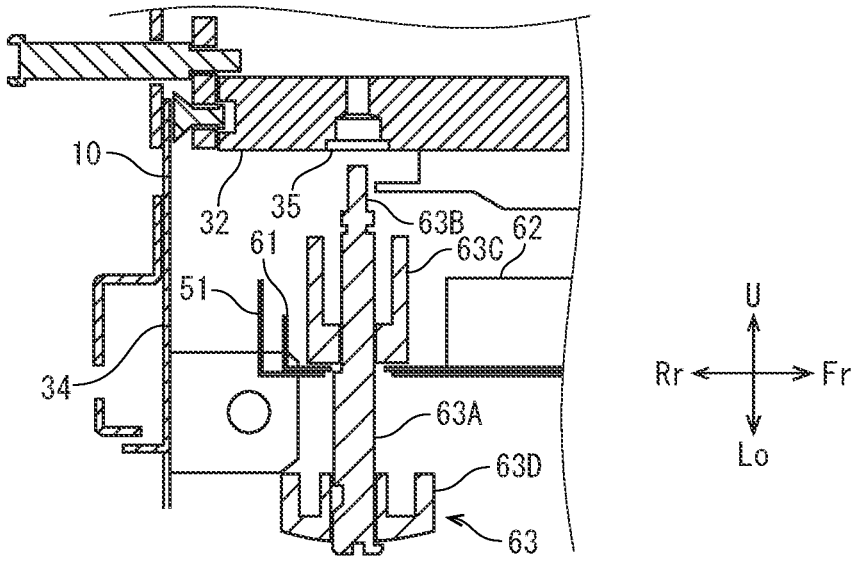
FIG. 12A is a sectional view showing a rear side sub-base part mounting screw and the recording head housing according to the embodiment of the present disclosure.
Figure 12B:
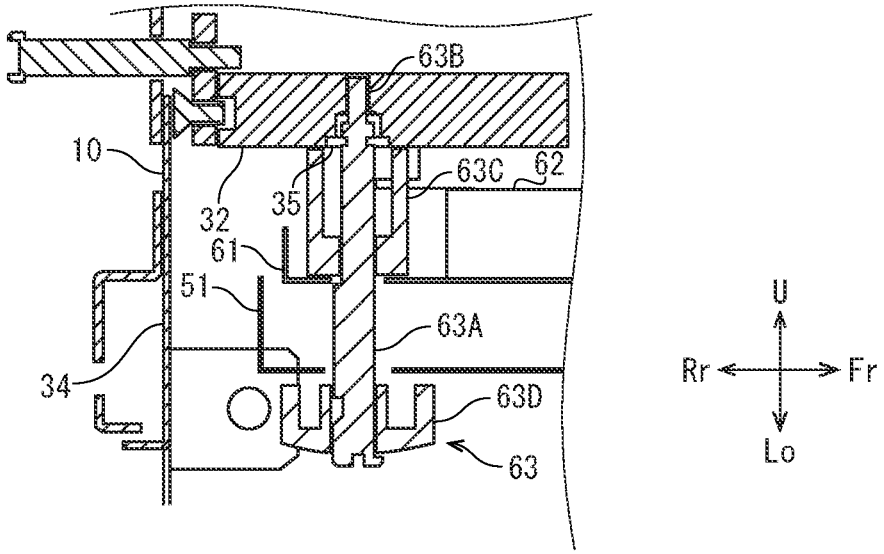
FIG. 12B is a sectional view showing the rear side sub-base part mounting screw and the recording head housing according to the embodiment of the present disclosure.
Figure 13A:
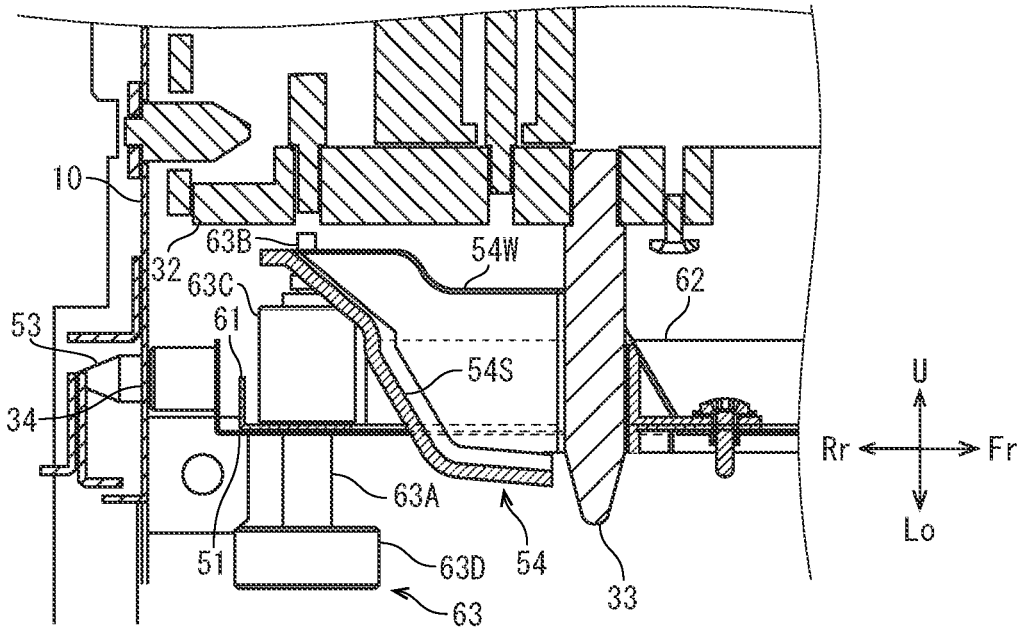
FIG. 13A is a sectional view showing the resin guide and a positioning pin according to the embodiment of the present disclosure.
Figure 13B:
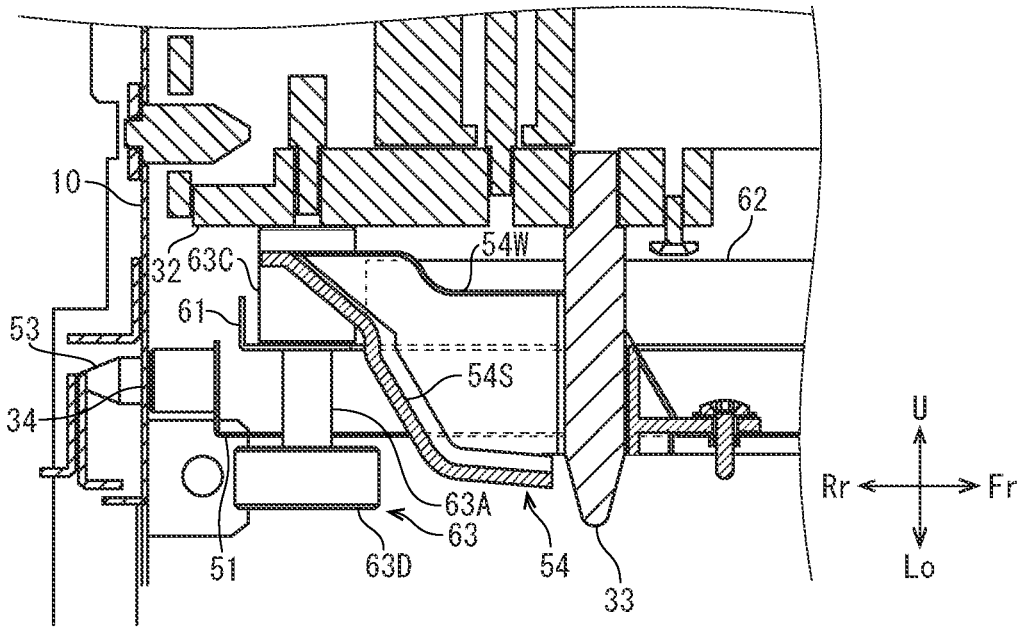
FIG. 13B is a sectional view showing the resin guide and the positioning pin according to the embodiment of the present disclosure.

[Second cap unit] Next, a second cap unit 50 will be described. FIG. 7 is a perspective view showing the second cap unit 50. FIG. 8A and FIG. 8B are perspective views showing the front end portion of the second cap unit 50. FIG. 9A and FIG. 9B are sectional views showing a front side sub-base part mounting screw 63 and the recording head housing 32. FIG. 10 is a perspective view showing a resin guide 54 and its periphery. FIG. 11A and FIG. 11B are sectional view showing the resin guide 54 and its periphery. FIG. 12A and FIG. 12B are sectional views showing a rear side sub-base part mounting screw 63 and the recording head housing 32. FIG. 13A and FIG. 13B are sectional views showing the resin guide 54 and the positioning pin 33.

The printer 1 includes the recording heads 31 which have the ejecting ports on the lower faces, the recording head housing 32 (an example of a housing) which supports the recording heads 31, and elastic caps 62 (an example of a cap). The printer 1 further includes the second cap unit 50 as an example of a cap unit, the positioning pin 33 (an example of a protrusion), and a resin guide 54 (an example of a guide part). The second cap unit 50 is inserted into a space below the recording heads 31 in a direction from the front side to the rear side (an example of a predetermined direction) and attached to the recording head housing 32 such that the elastic caps 62 cover the lower faces of the recording heads 31. The positioning pin 33 is protruded downward lower than the lower face of the recording head 31 from the rear side portion (an example of a rear side portion in the predetermined direction) of the lower portion of the recording head housing 32. The resin guide 3 is formed on the rear side portion (an example of a rear side portion in the predetermined direction) of the upper portion of the second cap unit 50, and comes into contact with the positioning pin 33 to guide the insertion and removal of the second cap unit 50. Special example is described below. The recording head 31, the recording head housing 32 and the positioning pin 33 are described above. The insertion and removal are performed while bringing the resin guide 54 into contact with the positioning pin 33, so that it becomes possible to move the second cap unit 50 along a steady track and to perform the insertion and removal of the second cap unit 50 easily. However, it is not necessarily required that the resin guide 54 and the positioning pin 33 are not in contact with each other before the insertion and removal.

The second cap unit 0 (refer to FIG. 7) includes a base part 51 (an example of a lower layer part), a sub-base part 61 (an example of an upper layer part), the elastic caps 62, a sub-base part mounting screw 63, and the resin guide 54.

[Base part] The base part 51 is a rectangular plate-shaped member facing the entire of the recording head unit 30. In the rear end portion of the base part 51, a pair of left and right fixing pins 53 (an example of a rear end portion in the predetermined direction) is protruded rearward (refer to FIG. 11A). The fixing pin 53 is inserted into a fixing pin hole 34 (an example a fitting part) formed in the main body housing 10 (refer to FIG. 13A). In the front end portion of the base part 51, a pair of left and right screw fastening parts 56 is formed (refer to FIG. 8A). The screw fastening part 56 has a through hole, and fixed to the main body housing 10 by a screw (not shown) (refer to FIG. 9A).

[Sub-base part] The sab-base part 61 (refer to FIG. 7) is a rectangular plate-shaped member whose longitudinal direction is along the front-and-rear direction. Above the base part 51, the four sub-base parts 61 are disposed side by side in the left-and-right direction for each color of the inks. A length of the sub-base part 61 in the front-and-rear direction is mostly equal to that of the base part 51, and a width of the sub-base part 61 in the left-and-right direction is almost ¼ of that of the base part 51.

[Elastic cap] On the upper face of each sub-base part 61, three elastic caps 62 are disposed in the same zigzag manner as the recording head 3. The elastic cap 62 (refer to FIG. 10) includes a parallelepiped sponge 62S and a fluorine-based sheet 62F. The sponge 62S has an upper face of a size corresponding to the lower face of the recording head 31. The sheet 62F covers the upper face and the left and right side faces of the sponge 62S.

[Sub-base part mounting screw] At both front and rear end portions of the sub-base part 61, sub-base part mounting screws 63 (refer to FIG. 8A and FIG. 11A) are provided. The sub-base part mounting screw 63 includes a shaft part 63A, a screw part 63B formed on the upper portion of the shaft part 63A, a spacer part 63C provided below the screw part 63B and capable of idling with respect to the shaft part 63A, and a head part 63D formed on the lower end of the shaft part 63A. The head part 63D is disposed below the base part 51, and the lower face of the spacer part 63C is fixed to the upper face of the sub-base part 61.

The screw part 63B is tightly screwed in a sub-base part mounting screw hole 35 formed in the recording head housing 32 (refer to FIG. 9A and FIG. 12A). Since a diameter of a part in the circumferential direction of the lower portion of the shaft part 63A is larger than that of the upper portion, the relative lowering of the spacer part 63C with respect to the shaft part 63A is restricted. Therefore, as the shaft part 63A is moved upward with the screwing of the screw part 63B, the spacer part 63C and the sub-base part 61 are moved upward (refer to FIG. 8B, FIG. 9B, FIG. 11B, FIG. 12B and FIG. 13B).

[Resin guide] The resin guide 54 (refer to FIG. 7, FIG. 10 and FIG. 11A) has an inclined part 54S and a pair of wall parts 54W. The inclined part 54S is inclined to be higher toward the rear side (an example of a rear side in the predetermined direction). The wall parts 54W are formed on the front side of the inclined part 54S, and face each other in the left-and-right direction (an example of a direction perpendicular to the predetermined direction). In a space surrounded by the inclined part 54S and the pair of wall parts 54W, the positioning pin 33 is insertable. A distance W of the wall parts 54W in the left-and-right direction is wider than a width of the positioning pin 33. The resin guide 54 is made of silicon resin, liquid crystal resin or the like.

The resin guide 54 is mounted on the upper face of the base part 51. In the other words, the resin guide 54 is protruded more upward than the upper face of the base part 51. The sab-base part 61 has a trough hole slightly larger than the lower portion of the resin guide 54, and the sab-base part 61 does not interfere with the resin guide 54 when the sub-base part 61 is moved upward owing to the screwing of the sab-base part mounting screw 63. A height between the upper face of the base part 51 and the upper end of the resin guide 54 is equal to or smaller than a distance between the upper face of the base part 51 and the lower face of the recording head housing 32 at a predetermined attachment position.

Next, an attachment and detachment of the second cap unit 50 will be described. FIG. 14A to FIG. 18 are sectional views showing an attachment procedure of the second cap unit 50. FIG. 14A, FIG. 15A, FIG. 16A, FIG. 17A and FIG. 18 are general views showing the second cap unit and FIG. 14B, FIG. 15B, FIG. 16B and FIG. 17B are enlarged views showing the rear portion of the second cap unit. The attachment work of the second cap unit 50 is performed at a time of shipping a finished product of the printer 1 or in a case where the printer 1 is not used for a long period after installation.

First, the operator opens a front door (not shown) of the printer 1, and secures a space into which the second cap unit 50 is to be inserted. At this time, in view of workability, it is desired to remove the print and conveyance unit 40 and the treatment unit 70 from the main body housing 10.

Figure 14A:
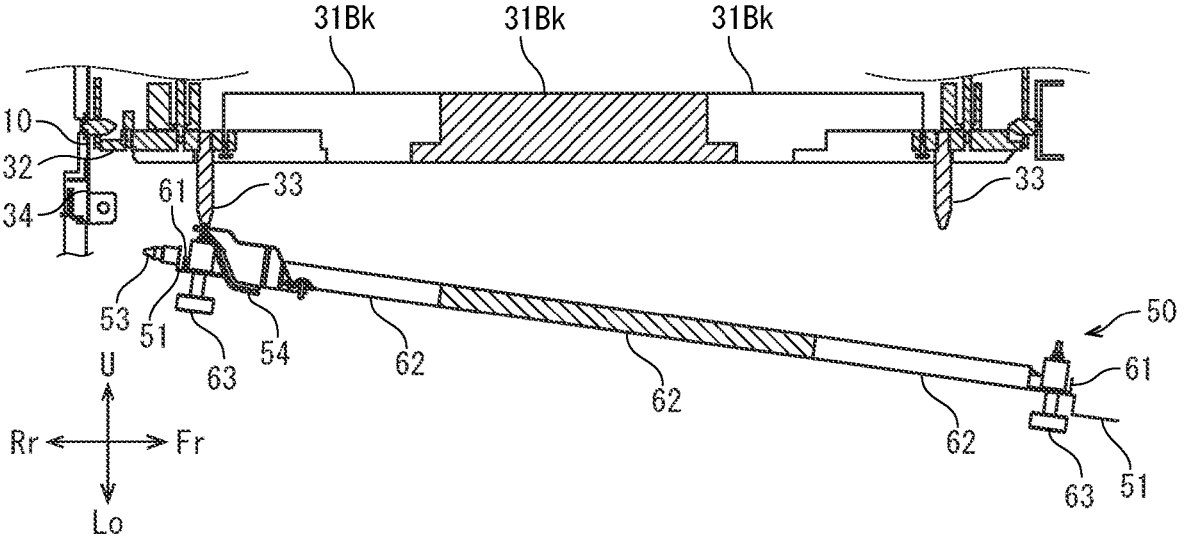
FIG. 14A is a sectional view showing an attachment process of the second cap unit according to the embodiment of the present disclosure.
Figure 14B:
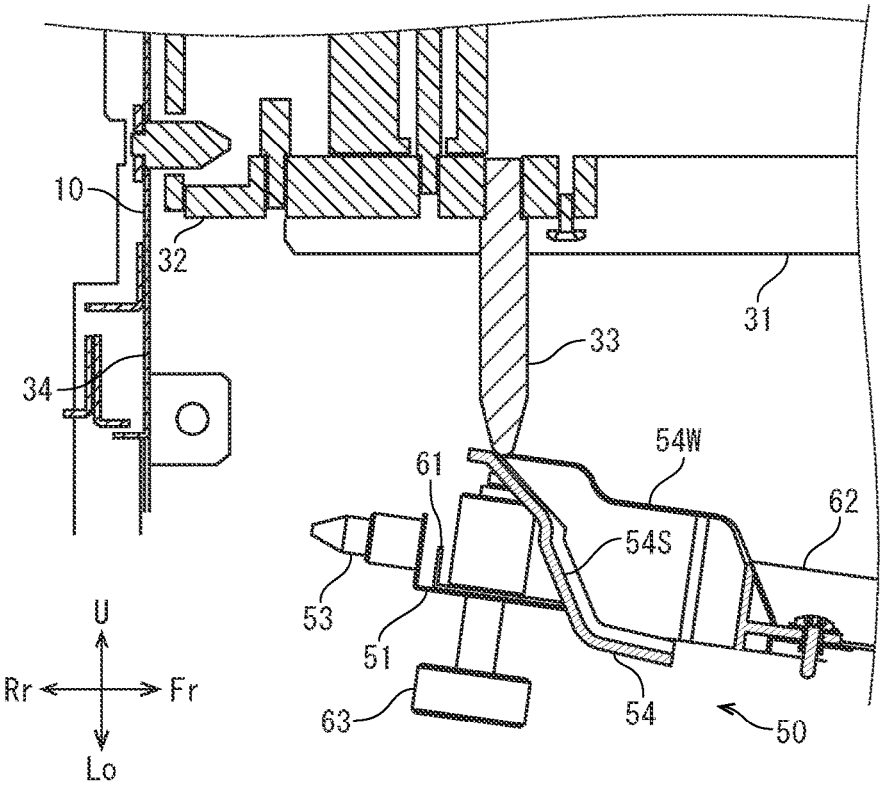
FIG. 14B is a sectional view showing the attachment process of the second cap unit according to the embodiment of the present disclosure.
Figure 15A:
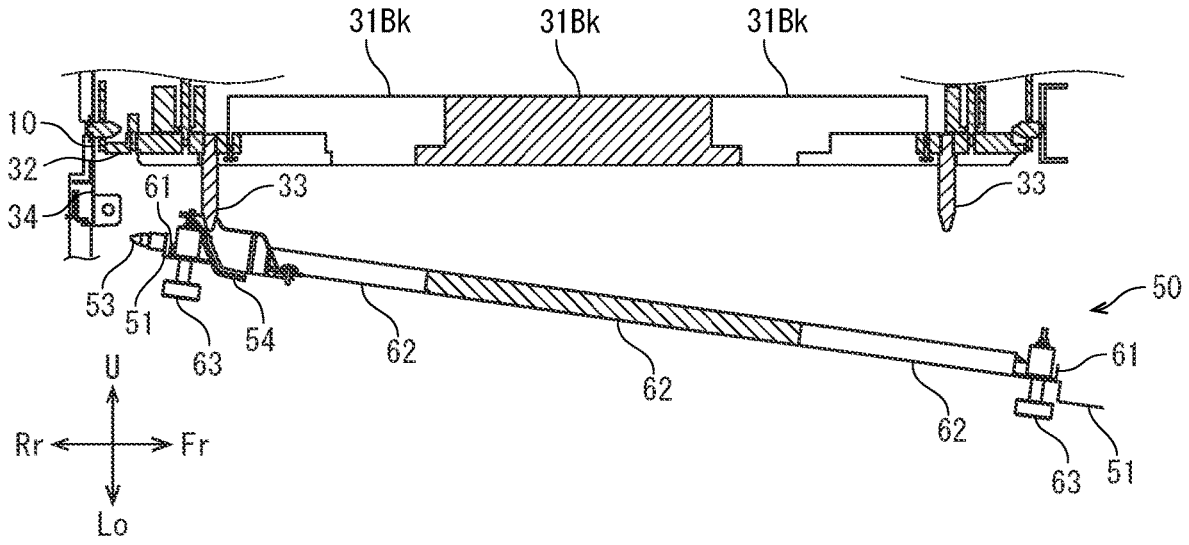
FIG. 15A is a sectional view showing the attachment process of the second cap unit according to the embodiment of the present disclosure.
Figure 15B:
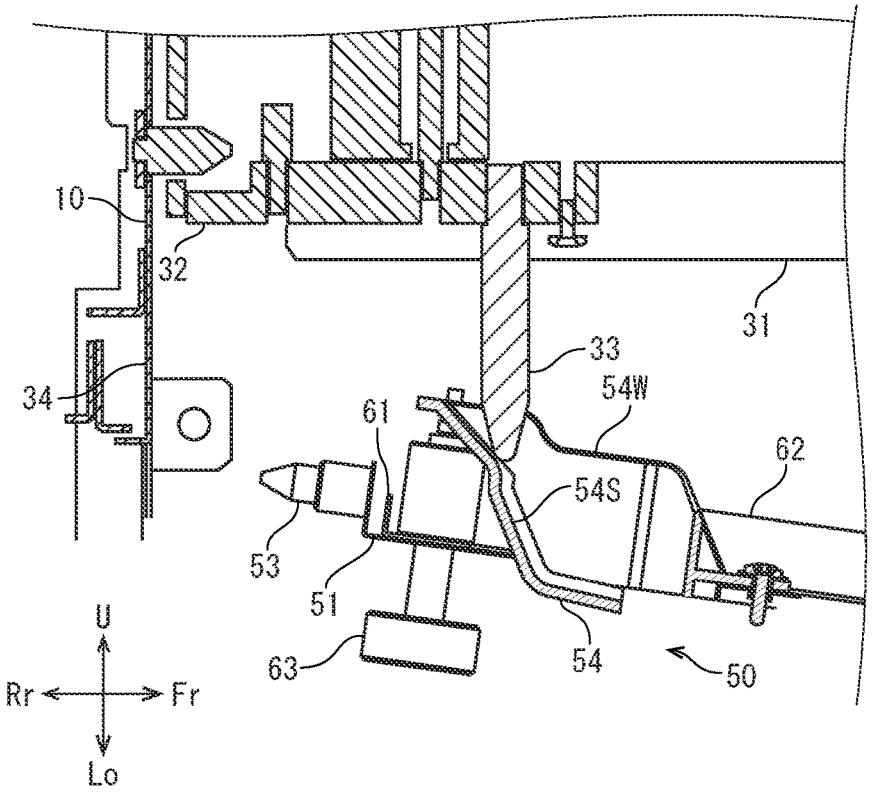
FIG. 15B is a sectional view showing the attachment process of the second cap unit according to the embodiment of the present disclosure.
Figure 16A:
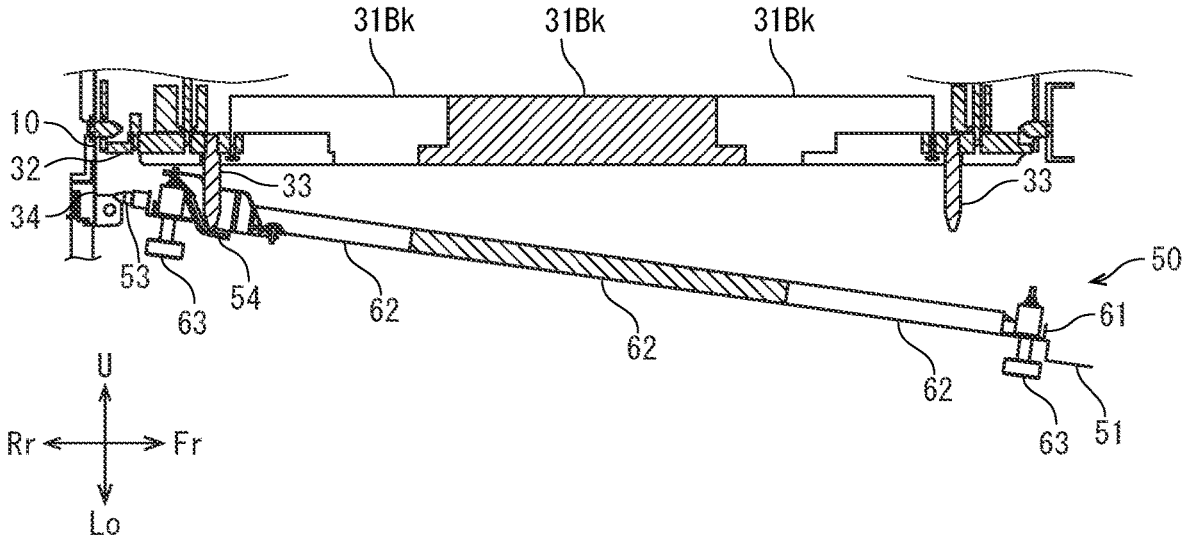
FIG. 16A is a sectional view showing the attachment process of the second cap unit according to the embodiment of the present disclosure.
Figure 16B:
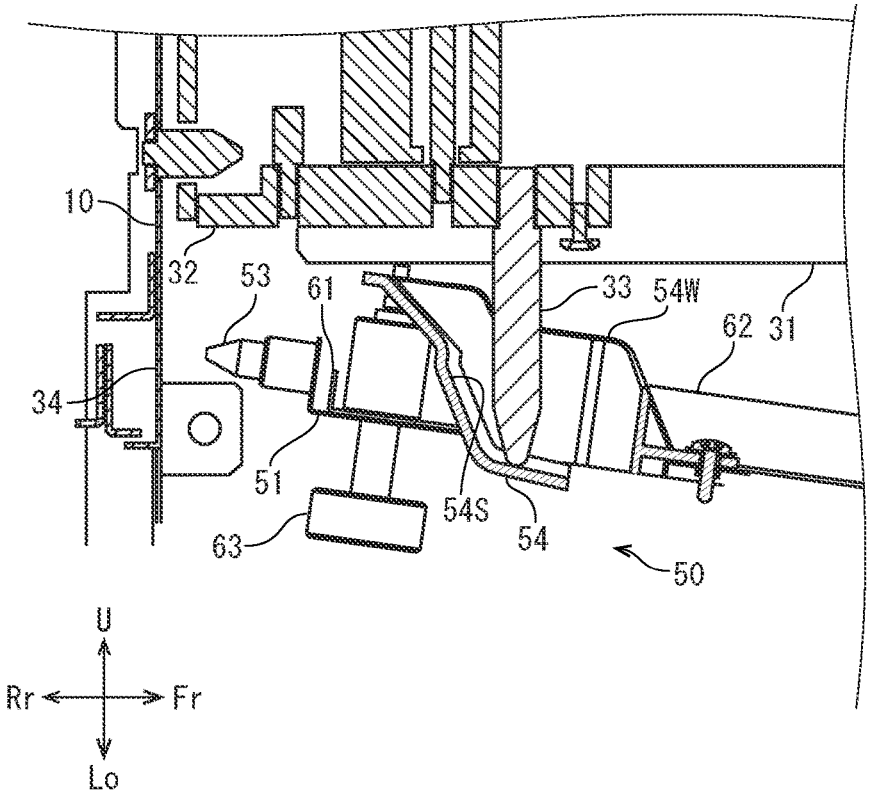
FIG. 16B is a sectional view showing the attachment process of the second cap unit according to the embodiment of the present disclosure.

Next, the operator inclines the second cap unit 50 such that the rear portion is lower than the front portion, inserts the second cap unit 50 from the front side to the rear side into the main body housing 10, roughly positions it such that the resin guide 54 is below the positioning pin 33, and then brings the inclined part 54S of the resin guide 54 into contact with the lower end portion of the positioning pin 33 (refer to FIG. 14A and FIG. 14B).

Then, the operator inserts the second cap unit 50 in the rear side gradually while bringing the inclined part 54A of the resin guide 54 into contact with the lower end portion of the positioning pin 33 (refer to FIG. 15A to FIG. 16B). During this time, because the upward moving of the resin guide 54 is restricted by the positioning pin 33, it becomes possible to prevent the rear end portion of the second cap unit 50 from coming into contact with the recording head 31.

Figure 17A:
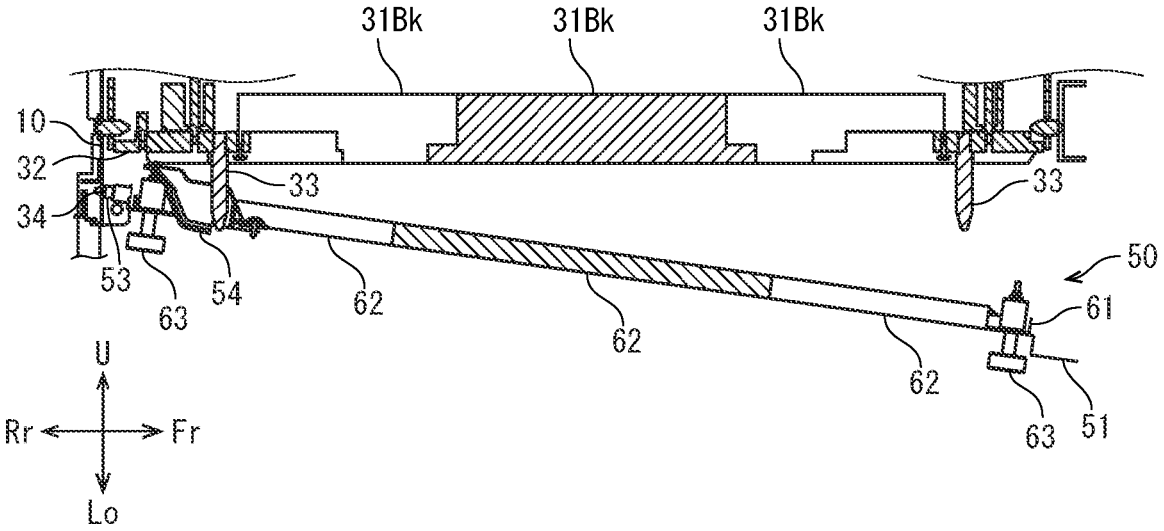
FIG. 17A is a sectional view showing the attachment process of the second cap unit according to the embodiment of the present disclosure.
Figure 17B:
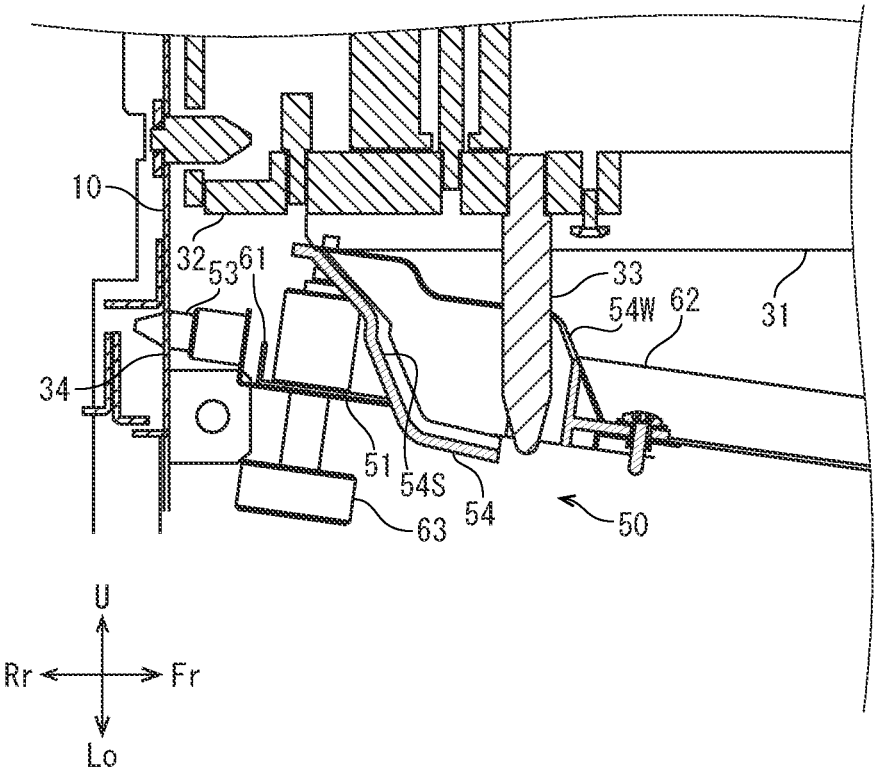
FIG. 17B is a sectional view showing the attachment process of the second cap unit according to the embodiment of the present disclosure.
Figure 18:
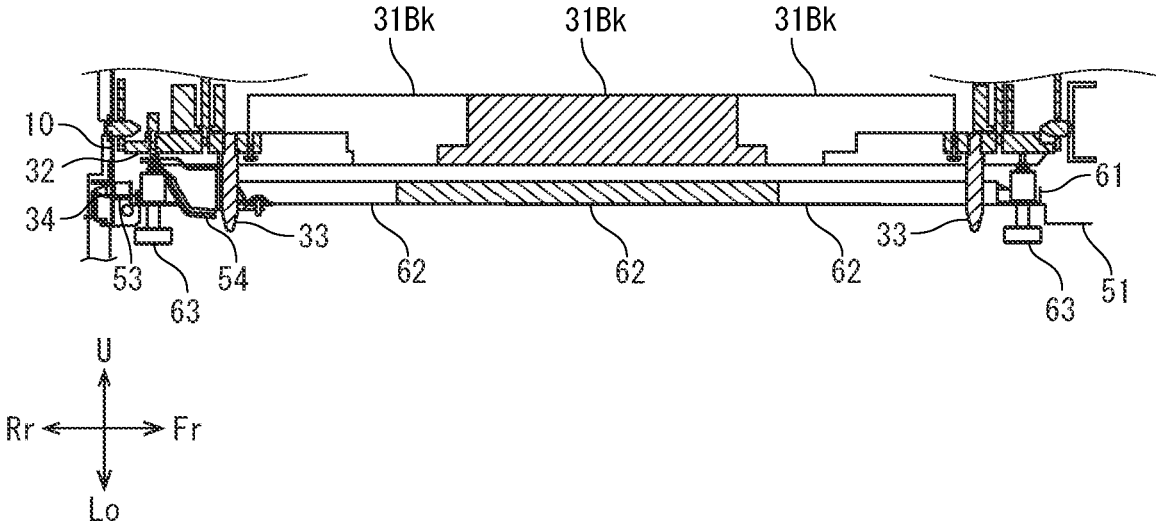
FIG. 18 is a sectional view showing the attachment process of the second cap unit according to the embodiment of the present disclosure.

Then, the operator inserts the fixing pin 53 of the second cap unit 50 into the fixing pin hole 34 of the main body housing 10 (refer to FIG. 17A and FIG. 17B). At this time, because the lower end portion of the inclined part 54S is positioned on the rear side of the positioning pin 33, the upward moving of the resin guide 54 is not restricted. The operator lifts the front portion of the second cap unit 50 upward and holds the second cap unit 50 in almost a horizontal posture (refer to FIG. 18).

Next, the operator fixes the screw fastening part 56 of the front end portion of the base part 51 to the main body housing 10 using a screw (refer to FIG. 9A). By the above procedures, the base part 51 is fixed to the main body housing 10. FIG. 12A and FIG. 13A show the rear portion of the second cap unit 50 when the base part 51 is fixed to the main body housing 10.

Next, the operator fastens the sab-base part mounting screw 63 to the recording head housing 32 (refer to FIG. 9B, FIG. 12B and FIG. 13B). As the sub-base part mounting screw 63 is screwed, the sub-base part 61 is lifted together with the spacer part 63C, the upper end portion of the spacer part 63C comes into contact with the lower face of the recording head housing 32, and then the fastening of the sub-base mounting screw 63 is completed. At this time, the elastic cap 62 covers the lower face of the recording head 31. In detail, the elastic cap 62 is pressed on the lower face of the recording head 31, and the ejecting ports are sealed. Then, the attachment of the second cap unit 50 is completed.

After the installation of the printer or in a case where the printer 1 which has not been used for a long period is used again, the second cap unit 50 is removed in the reverse procedures. First, the operator loosens the sub-base part mounting screw 63. At this time, as shown in FIG. 13A, because the lower end portion of the inclined part 54S of the resin guide 54 faces the side face of the positioning pin 33, if it is desired to move the second cap unit 50 forward while keeping the posture, the movement of the second cap unit 50 is restricted by the positioning pin 33, and it becomes impossible to remove the fixing pin 53 from the fixing pin hole 34. Then, the operator necessarily removes the fixing pin 53 after he inclines the second cap unit 50 such that the rear portion is lower than the front portion. Then, the operator moves the second cap unit 50 forward. At this time, the inclined part 54S of the resin guide 54 comes into contact with the lower end portion of the positioning pin 33, so that as the second cap unit 50 is moved forward, the rear end portion of the second cap unit 50 is guided downward and the resin guide 54 is therefore prevented from coming into contact with the recording head 31.

According to the above described printer 1 according to the present embodiment, the resin guide 54 guides the insertion and removal of the second cap unit 50 by bringing into contact with the positioning pin 33 so that it becomes possible to attach and detach the second cap unit 50 easily.

According to the printer 1 of the present embodiment, because the positioning pin 33 can be inserted into the space formed by the inclined part 54S and the pair of wall parts 54W of the resin guide 54, the insertion and removal of the second cap unit 50 is guided by bringing the positioning pin 33 into contact with the inner faces of the inclined part 54S and the wall part 54W of the resin guide 54.

Further, according to the printer 1 of the present embodiment, because the distance between the wall parts 54W is wider than the width of the positioning pin 33, the insertion and removal of the second cap unit 50 is guided even if the position is slightly shifted in the left-and-right direction.

Further, according to the printer 1 of the present embodiment, because the resin guide 54 is protruded more upward than the upper face of the second cap unit 50, it becomes possible to prevent the recording head 31 from being damaged due to contact with the rear end portion of the second cap unit 50.

Further, according to the printer 1 of the present embodiment, because the main body housing 10 includes the fixing pin hole 34 into which the fixing pin 53 of the second cap unit 50 is fitted, and the lower end portion of the inclined part 54S of the resin guide 54 faces the side face of the positioning pin 33 when the fixing pin 53 is fitted into the fixing pin hole 34, it is necessary to lower the front portion of the second cap unit 50 when the fixing pin 53 is removed from the fixing pin hole 34. Thus, it becomes possible to prevent the resin guide 54 from bringing into contact with the recording head 31.

Further, according to the printer 1 of the present embodiment, the resin guide 54 is made of resin. On the other hand, because the lower face of the recording head 31 is made of metal harder than resin, even when the resin guide 54 comes into contact with the recording head 31, it becomes possible to prevent the recording head 31 from being damaged due to contact with the resin guide 54.

Further, according to the printer 1 of the present embodiment, there is provided the liftable and lowerable print and conveyance unit 40 which conveys the sheet S below the recording head 31. The print and conveyance unit 40 is provided with the positioning pin hole 44 in which the positioning pin 33 is fitted when the print and conveyance unit 40 is lifted, to position the print and conveyance unit 40. The second cap unit 50 is inserted into the space formed below the recording head 31 when the print and conveyance unit 40 is lowered, and then is attached on the lower face of the recording head 31. Therefore, the addition of the positioning pin 33 is unnecessary.

Further, according to the printer 1 of the present embodiment, because the elastic cap 62 includes the sponge 62S and the fluorine-based sheet 62F covering the sponge 62S, the sealing property of the lower surface of the recording head 31 can be enhanced.

Further, according to the printer 1 of the present embodiment, because the second cap unit 50 includes the base part 51 mounted to the main body housing 10 and the sub-base part 61 provided above the base part 51, including the elastic cap 62 and capable of being lifted and lowered, it becomes possible to press the elastic cap 62 on the lower face of the recording head 31 reliably.

Further, according to the printer 1 of the present embodiment, the plurality of recording heads 31 are provided, and the second cap unit 50 includes the plurality of sub-base part 61 each of which faces the recording head 31 and can be independently lifted and lowered. Therefore, the sealing property can be maintained by vibrating the sub-base part 61 following the recording head 31 even when the phases of the vibrations are different for each recording head 31.

The above embodiment may be modified as follows.

In the above embodiment, the resin guide 54 has the inclined part 54S and the pair of wall parts 54W, but the gap between the wall parts 54W may be narrower toward the lower side. The resin guide 54 may be formed in a funnel-like shape. According to this configuration, because the positioning of the second cap unit 50 in the left-and-right direction becomes easy, the fixing pin 53 can be easily inserted into the fixing pin hole 34.

In the embodiment described above, the four sub-base parts 61 are provided for each color of the inks, but for example, one sub-base part 61 that faces all of the recording head units 30 may be provided. Further, the sub-base part 61 facing the recording head 31Y and the recording head 31Bk and the sub-base part 61 facing the recording head 31C and the recording head 31M may be provided.

In the above embodiment, the recording head housing 32 includes the positioning pin 33, and the second cap unit 50 includes the resin guide 54. However, the second cap unit 50 may include the positioning pin 33 protruding upward, and the recording head housing 32 may include the resin guide 54 which is inverted in the upper-and-lower direction and the front-and-rear direction with respect to the above embodiment.

Further, the resin guide 54 may be coated with material having luminous properties (for example, strontium aluminate). According to this configuration, because the resin guide 54 emits light, the insertion and removal work of the second cap unit 50 becomes easy.

The present disclosure is also specified as the printer 1 (an example of an inkjet recording apparatus) characterized by including: the plurality of recording heads 31 having ink ejecting ports formed on the lower face; the recording head housing 32 (an example of a housing) which supports the plurality of recording heads 31; and the second cap unit 50 (an example of a cap unit) provided with the elastic cap 62 (an example of a cap) which covers the lower face of the plurality of recording heads 31. The second cap unit 50 is inserted into the space below the plurality of recording heads 31 in the predetermined direction to be attached to the recording head housing 32. The second cap unit 50 includes the base part 51 (an example a lower layer part) which is mounted to the recording head housing 32 and the sub-base part 61 (an example an upper later part) provided above the base part 51 and including the elastic cap 62. Each of the sub-base parts 61 face the recording head 31 and is capable of being lifted and lowered independently. According to this structure, even when the phases of the vibrations are different for each recording head 31, the sub-base part 61 vibrates following the recording head 31, so that the elastic cap 62 is hardly displaced from the recording head 31. In particular, when the lower face of the recording head 31 is sealed with the elastic cap 62, the sealing property can be maintained. Therefore, the sealing property is not lowered even if the second cap unit 50 is not particularly firmly fixed, so that the second cap unit 50 can be easily attached and detached.

While the embodiments of the present disclosure have been described, the embodiments are shown by way of example and are not intended to limit the scope of the disclosure.

The invention claimed is:

1. An inkjet recording apparatus comprising:

a recording head having an ink ejecting port on a lower face;

a housing which supports the recording head;

a cap unit including a cap, the cap unit inserted into a space below the recording head in a predetermined direction to be attached to the housing and to cover the lower face of the recording head with the cap;

a protrusion protruding from a lower portion of the housing on a rear side in the predetermined direction more downward than the lower face of the recording head; and a guide part formed in an upper portion of the cap unit on the rear side in the predetermined direction and coming into contact with the protrusion so as to guide insertion and removal of the cap unit.

2. The inkjet recording apparatus according to claim 1; wherein the guide part includes:

an inclined part inclined so as to be higher toward the rear side in the predetermined direction; and a pair of wall parts formed on a front side of the inclined part in the predetermined direction and facing each other in a direction crossing the predetermined direction, wherein the protrusion is capable of being inserted into a space formed by the inclined part and the pair of wall parts.

3. The inkjet recording apparatus according to claim 2, wherein a distance between the wall parts is wider than a width of the protrusion.

4. The inkjet recording apparatus according to claim 2, wherein a distance between the wall parts becomes narrower toward a lower side.

5. The inkjet recording apparatus according to claim 2, wherein the guide part is protruded more upward than an upper face of the cap unit.

6. The inkjet recording apparatus according to claim 5, wherein the housing includes a fitting part into which an end portion of the cap unit on the rear side in the predetermined direction is fitted, and when the end portion is fitted into the fitting part, a lower end portion of the inclined part faces a side face of the protrusion.

7. The inkjet recording apparatus according to claim 2, wherein the lower face of the recording head is made of metal, and the guide part is made of resin.

8. The inkjet recording apparatus according to claim 1, comprising a liftable and lowerable conveyance unit which conveys a sheet below the recording head, wherein the conveyance unit includes a recess into which the protrusion is fitted when the conveyance unit is lifted, and the cap unit is inserted into a space formed below the recording head when the recording head is lowered and then attached to the lower face of the recording head.

9. The inkjet recording apparatus according to claim 1, wherein the cap includes a sponge and a fluorine-based sheet which covers the sponge.

10. The inkjet recording apparatus according to claim 1, wherein the cap unit includes:

a lower layer part attached to the housing; and an upper layer part provided above the lower layer part, including the cap and capable of being lifted and lowered.

11. The inkjet recording apparatus according to claim 10, comprising a plurality of the recording heads, wherein the cap unit includes a plurality of the upper layer parts, each of the upper layer parts facing each of the recording heads and capable of being lifted and lowered independently.

12. The inkjet recording apparatus according to claim 1, wherein the cap unit is detached from the housing by drawing it from the housing in a direction opposite to the predetermined direction.

13. An inkjet recording apparatus comprising:

a plurality of recording heads each having an ink ejecting port on a lower face;

a housing which supports the plurality of recording heads; and a cap unit including a plurality of caps, the cap unit inserted into a space below the plurality of recording heads in a predetermined direction to be attached to the housing and to cover lower faces of the recording heads with the caps, wherein the cap unit includes:

a lower layer part mounted to the housing; and a plurality of upper layer parts provided above the lower layer part and including the caps, each of the upper layer parts facing each of the recording heads and capable of being lifted and lowered independently.

* * * * *